US006746984B2

(12) United States Patent
Suzuki et al.

(10) Patent No.: US 6,746,984 B2
(45) **Date of Patent: *Jun. 8, 2004**

(54) IMAGE-FORMING MEDIUM COATED WITH MICROCAPSULE LAYER FOR FORMING IMAGE

(75) Inventors: Minoru Suzuki, Tochigi (JP); Kazuyuki Shimbo, Kanagawa (JP); Yutaka Igari, Fukushima (JP)

(73) Assignee: PENTAX Corporation, Tokyo (JP)

( * ) Notice: Subject to any disclaimer, the term of this patent is extended or adjusted under 35 U.S.C. 154(b) by 326 days.

This patent is subject to a terminal disclaimer.

(21) Appl. No.: 09/730,571

(22) Filed: Dec. 7, 2000

(65) Prior Publication Data

US 2001/0003730 A1 Jun. 14, 2001

(30) Foreign Application Priority Data

Dec. 8, 1999 (JP) ..... P11-348859
Feb. 21, 2000 (JP) ..... P2000-042507

(51) Int. Cl.[7] ..... B41M 5/20; B41M 5/24
(52) U.S. Cl. ..... 503/215; 503/204
(58) Field of Search ..... 503/214, 215; 428/321.5

(56) References Cited

U.S. PATENT DOCUMENTS

| | | | | |
|---|---|---|---|---|
| 4,444,833 | A | 4/1984 | Moriguchi et al. | 503/204 |
| 5,104,767 | A | 4/1992 | Nakamura | 430/138 |
| 5,501,946 | A | 3/1996 | Takagi et al. | 430/573 |
| 6,106,173 | A | 8/2000 | Suzuki et al. | 400/120.02 |
| 6,109,800 | A | 8/2000 | Suzuki et al. | 400/120.02 |
| 6,139,914 | A | 10/2000 | Suzuki et al. | 427/213.3 |
| 6,161,971 | A | 12/2000 | Suzuki et al. | 400/120.01 |

FOREIGN PATENT DOCUMENTS

| | | |
|---|---|---|
| JP | 57150600 | 9/1982 |
| JP | 58-33492 | 2/1983 |
| JP | 58-82785 | 5/1983 |
| JP | 61137787 | 6/1986 |
| JP | 4-292985 | 10/1992 |
| JP | 6-51422 | 2/1994 |
| JP | 8-224962 | 9/1996 |
| JP | 8-282115 | 10/1996 |
| JP | 9-76634 | 3/1997 |

OTHER PUBLICATIONS

Hackh's Chemical Dictionary, p. 227, "Dye".*
English Language Abstract of JP 58–82785.
English Language Abstract of JP 58–33492.
English Language Abstract of JP 61–137787.

* cited by examiner

*Primary Examiner*—B. Hamilton Hess
(74) *Attorney, Agent, or Firm*—Greenblum & Bernstein, P.L.C.

(57) ABSTRACT

In an image-forming medium, a sheet of paper is coated with a layer of microcapsules which is composed of a binder material and a plurality of microcapsules filled with dye and uniformly distributed in the binder material. The binder material exhibits a predetermined thermal melting point, and the microcapsules exhibit a pressure-breaking characteristic so as to be squashed and broken under a predetermined pressure when said binder material is thermally softened or melted. When a leuco-pigment-based dye is used, a color developer is substituted for the binder material.

40 Claims, 18 Drawing Sheets

IMAGE-FORMING MEDIUM COATED WITH MICROCAPSULE LAYER FOR FORMING IMAGE

BACKGROUND OF THE INVENTION

1. Field of the Invention

The present invention relates to an image-forming medium, coated with a layer of microcapsules filled with dye, on which an image is formed on the microcapsule layer by selectively breaking and rupturing the microcapsules in the microcapsule layer.

2. Description of the Related Art

In a conventional type of image-forming medium coated with a layer of microcapsules filled with dye or ink, a shell wall of each microcapsule is formed from a suitable photosetting resin, and an optical image is recorded and formed as a latent image on the microcapsule layer by exposing it to light rays in accordance with image-pixel signals. Then, the latent image is developed by exerting a pressure on the microcapsule layer. Namely, the microcapsules, which are not exposed to the light rays, are broken, whereby the dye or ink is discharged from the broken microcapsules, and thus the latent image is developed by the discharged dye or ink.

Thus, the conventional image-forming medium must be packed so as to be protected from being exposed to light, resulting in a wastage of packing materials. Further, the image-forming medium must be handled such that they are not subjected to excess pressure due to the softness of unexposed microcapsules, resulting in an undesired discharging of the dye or ink Also, another type of image-forming medium, coated with a layer of microcapsules filled with different color dyes or inks based on diazo pigment, is known. The respective different color dyes or inks are transparent at normal ambient temperature, but each ink develops a monochromatic color at a specific temperature. Thus, the respective different colors are selectively developed on the microcapsule layer by selectively applying specific temperatures to the microcapsule layer. It is then necessary to fix the developed color by irradiation, using a light of a specific wavelength. Accordingly, this type of color-image-forming system is costly, because an additional irradiation apparatus for fixing the developed color is needed, and electric power consumption is increased due to the additional irradiation apparatus. Also, since a heating process for the color development and an irradiation process for fixing a developed color must be carried out with respect to each color, this hinders the quick formation of a color image on the image-forming medium.

SUMMARY OF THE INVENTION

Therefore, an object of the present invention is to provide an image-forming medium coated with a layer of microcapsules filled with ink or dye, in which an image can be quickly formed on the microcapsule layer at low cost without a large amount of wastage of packing materials, and which can be handled without special care.

In accordance with a first aspect of the present invention, there is provided an image-forming medium comprising a substrate, and a layer of microcapsules, coated over the substrate, composed of a binder material and a plurality of microcapsules filled with a dye and uniformly distributed in the binder material. The binder material exhibits a predetermined thermal melting point, and the microcapsules exhibit a pressure-breaking characteristic so as to be squashed and broken under a predetermined pressure when the binder material is thermally softened or melted.

The binder material may comprise either a wax material exhibiting the thermal melting point or a low-melting thermoplastic material exhibiting the thermal melting point. Preferably, the binder material comprises a plurality of binder particles which are adhered to each other such that a rockwork-like structure is given to the microcapsule layer.

The microcapsule may further include a vehicle and a dye or compound dispersed or dissolved in the vehicle. When the compound comprises a leuco-dye or leuco-compound, the binder material contains a color developer for the leuco-dye or leuco-compound.

The microcapsules may have a shell wall formed of a heat resistant synthetic resin which preferably comprises either a thermosetting resin or a high-melting thermoplastic resin.

Optionally, the dye may comprise a leuco-compound-based dye. In this case, the binder material comprises a color developer for the leuco-compound-based dye. Preferably, the color developer comprises a plurality of color developer particles which are adhered to each other such that a rockwork-like structure is given to the microcapsule layer. The microcapsule layer may contain a sensitizer for facilitating a color-developing reaction of the leuco-compound-based dye with the color developer.

In accordance with a second aspect of the present invention, there is provided an image-forming medium comprising a substrate, and a layer of microcapsules, coated over the substrate, including first and second microcapsule layer sections. The second microcapsule layer section is formed on the substrate, and the first microcapsule layer section is formed on the second microcapsule layer section. The first microcapsule layer section is composed of a first binder material, and a first type of microcapsules filled with a first dye and uniformly distributed in the first binder material, and the second microcapsule layer section is composed of a second binder material, and a second type of microcapsules filled with a second dye and uniformly distributed in the second binder material. The first binder material exhibits a first predetermined thermal melting point, and the first type of microcapsules exhibits a first pressure-breaking characteristic so as to be squashed and broken under a first predetermined pressure when the first binder material is thermally softened or melted. The second binder -material exhibits a second predetermined thermal melting point higher than the first thermal melting point, and the second type of microcapsules exhibits a second pressure-breaking characteristic so as to be squashed and broken under a second predetermined pressure lower than the first predetermined pressure when the second binder material is thermally softened or melted.

In the image-forming medium according to the second aspect of the present invention, the microcapsule layer may further include a third microcapsule layer section intervened between the substrate and the second microcapsule layer section. The third microcapsule layer section is composed of a third binder material, and a third type of microcapsules filled with a third dye and uniformly distributed in the third binder material, and the third binder material exhibits a third predetermined thermal melting point higher than the second thermal melting point, the third type of microcapsules exhibiting a third pressure-breaking characteristic so as to be squashed and broken under a third predetermined pressure lower than the second predetermined pressure when the third binder material is thermally softened or melted.

Preferably, an average diameter of the first type of microcapsules is smaller than an average diameter of the second type of microcapsules, and an average diameter of the second type of microcapsules is smaller than an average diameter of the third type of microcapsules.

The first microcapsule layer section may include a first type of spacer particles uniformly distributed therein and having an average diameter larger than an average diameter of the first type of microcapsules, and the second microcapsule layer section may include a second type of spacer particles uniformly distributed therein and having an average diameter larger than an average diameter of the second type of microcapsules. The spacer particles may be formed of an inorganic material. Optionally, the spacer particles may be formed of a high-melting synthetic resin.

Preferably, each of the first, second and third binder materials comprises a plurality of binder particles which are adhered to each other such that a rockwork-like structure is given to a corresponding microcapsule layer section.

Each of the first, second and third microcapsules may include a vehicle and a dye or compound dispersed or dissolved in the vehicle. When the dye or compound comprises a leuco-dye or leuco-compound, a color developer for the leuco-dye or leuco-compound is contained in a corresponding microcapsule layer section.

Optionally, the respective first, second and third dyes may comprise first, second and third leuco-compound-based dyes. In this case, the respective first, second and third binder materials comprise first, second and third color developers for the leuco-compound-based dyes. Preferably, each of the first and second color developers comprises a plurality of color developer particles which are adhered to each other such that a rockwork-like structure is given to a corresponding microcapsule layer section. Each of the first, second and third microcapsule layer sections may contain a sensitizer for facilitating a color-developing reaction of a corresponding leuco-compound-based dye with a corresponding color developer.

In accordance with a third aspect of the present invention, there is provided an image-forming medium comprising a substrate, and a layer of microcapsules, coated over the substrate, composed of a color developer, a first type of microcapsules filled with a first leuco-compound-based dye and uniformly distributed in the color developer, and a second type of microcapsules filled with a second leuco-compound-based dye and uniformly distributed in the color developer, the color developer exhibiting a predetermined thermal melting point. The first type of microcapsules exhibits a first pressure-breaking characteristic so as to be squashed and broken under a first predetermined temperature higher than the predetermined thermal melting point and a first predetermined pressure when the color developer is thermally softened or melted. The second type of microcapsules exhibits a second pressure-breaking characteristic so as to be squashed and broken under a second predetermined temperature higher than the first predetermined temperature and a second predetermined pressure lower than the first predetermined pressure when the color developer is thermally softened or melted.

Preferably, the second type of microcapsules has a double-shell-wall structure composed of an inner shell wall section and an outer shell wall section, one of which is thermally softened or melted under the second predetermined temperature.

Preferably, an average diameter of the first type of microcapsules is smaller than an average diameter of the second type of microcapsules, and the microcapsule layer includes a plurality of spacer particles having an average diameter larger than the average diameter of the first type of microcapsules but smaller than the average diameter of the second microcapsules.

Preferably, the color developer comprises a plurality of color developer particles which are adhered to each other such that a rockwork-like structure is given to the microcapsule layer.

The microcapsule layer may contain a sensitizer for facilitating a color-developing reaction of each leuco-compound-based dye with the color developer.

BRIEF DESCRIPTION OF THE DRAWINGS

The object and other objects of the present invention will be better understood from the following description and with reference to the accompanying drawings, in which.

DESCRIPTION OF THE PREFERRED EMBODIMENTS

Figure 1:
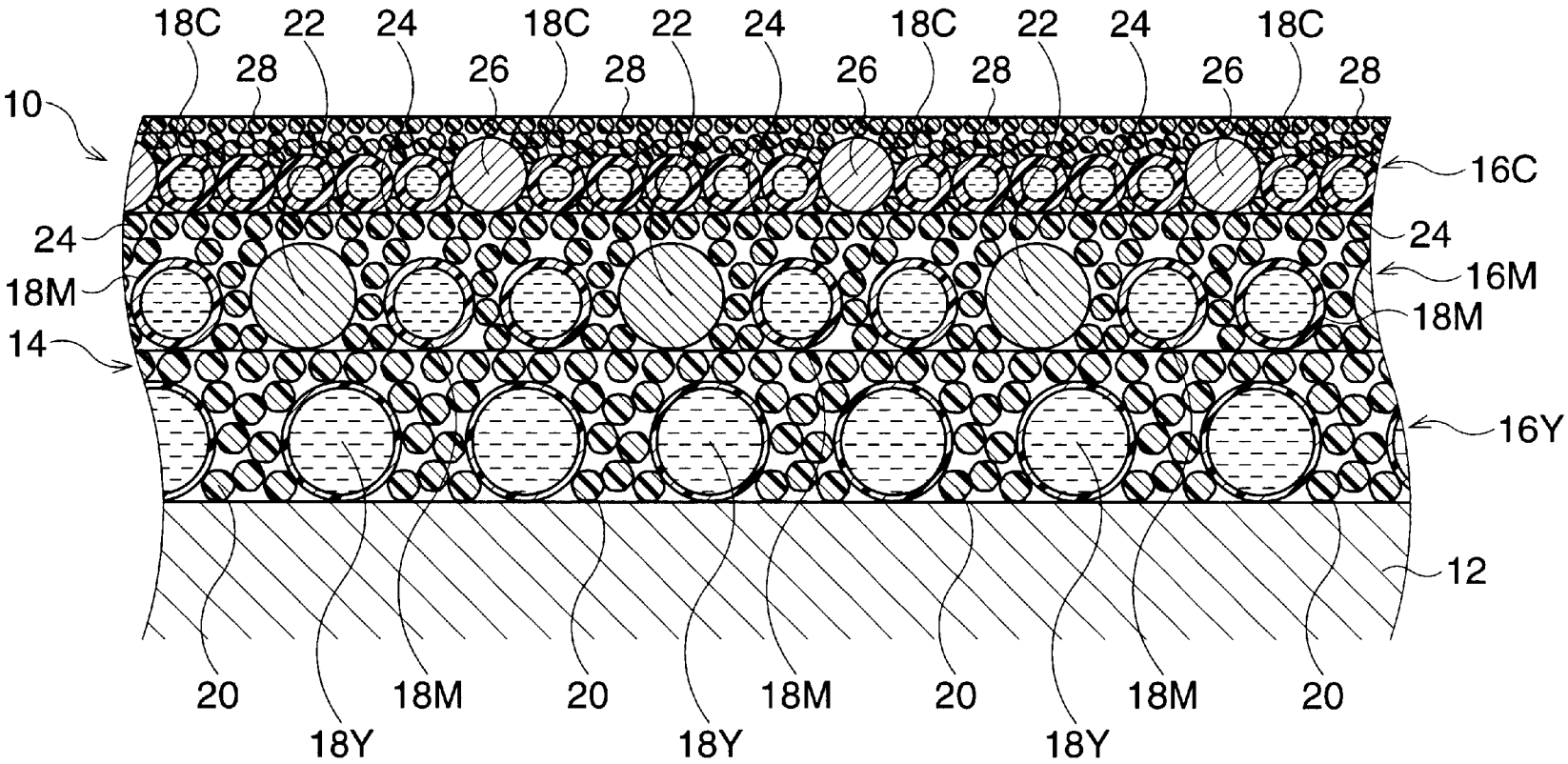
FIG. 1 is a schematic conceptual cross-sectional view showing a first embodiment of an image-forming medium, according to the present invention, coated with a layer of microcapsules which includes first, second and third microcapsule layer sections for forming a full color image thereon.

FIG. 1 schematically shows a first embodiment of an image-forming medium, generally indicated by reference numeral 10, according to the present invention. The image-forming medium 10 comprises a sheet-like substrate, such as a sheet of paper 12, and a layer of microcapsule 14 formed thereon. In this embodiment, the microcapsule layer 14 has a three-ply structure for forming a full color image thereon. In particular, the microcapsule layer 14 includes a first microcapsule layer section 16C for forming a cyan image, a second microcapsule layer section 16M for forming a magenta image, and a third microcapsule layer section 16Y for forming a yellow image. In the production of the image-forming medium 10, first, the third microcapsule layer section 16Y is formed on the paper sheet 12, the second microcapsule layer section 16M is formed on the third microcapsule layer section 16Y, and the first microcapsule layer section is formed on the second microcapsule layer section 16M.

Figure 2:
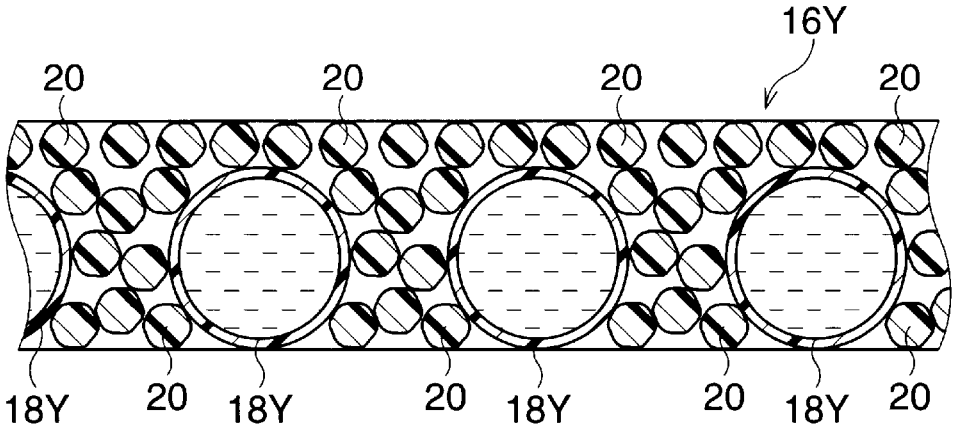
FIG. 2 is an enlarged schematic cross-sectional view of the third microcapsule layer section of the image-forming medium shown in FIG. 1.

As shown in FIGS. 1 and 2, the third microcapsule layer section 16Y has a structure in which a plurality of microcapsules 18Y, filled with a yellow ink or dye, are uniformly distributed in a rockwork-like arrangement of wax-type binder particles 20.

A shell wall of each microcapsule 18Y is formed of a suitable amino resin (thermosetting resin) colored with the same single color (usually white) as the paper sheet 12, and the yellow dye contained in each microcapsule 18Y is prepared as a yellow oil dye composed of transparent oil containing about 10 wt. % of yellow pigment. For the transparent oil, 2,7-di-isopropyl naphthalene, exhibiting a boiling point of about 300° C., which is available as KMC-113 from Rütgers Kureha Solvents (RKS) GmbH, is used. Also, for the yellow pigment, benzine yellow G is used.

To produce the microcapsules 18Y, a polymerization method, such as interfacial polymerization, in-situ polymerization or the like, may be utilized. Note that the polymerization method is disclosed in, for example, Unexamined Japanese Patent Publications No. 58-33492 and No. 58-82785. The microcapsules 18Y have an average diameter of about $9\mu$ to $10\mu$, and the shell wall of each microcapsule 18Y has a thickness such that each microcapsule 18Y is squashed and broken when being subjected to a pressure of higher than about 0.02 MPa, with a shearing force.

On the other hand, for the wax-type binder particles 20, polypropylene wax powder, which is available as PPW-5 from SEISHIN K.K., is used. The polypropylene wax powder (PPW-5) has an average diameter of about $3\mu$ to $5\mu$, and exhibits a thermal melting point of about 150° C. Note, the polypropylene wax powder exhibits white.

The third microcapsule layer section 16Y with the rockwork-like structure is produced by the following processes:

(1) 10 g of the polypropylene wax powder (PPW-5) and 10 g of microcapsules 18Y are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The paper sheet 12 is coated with the suspension at about 3 g to 5 g per square meter, using a spray gun, and then the coated layer is allowed to naturally dry. When the drying of the coated layer is completed, the wax type binder particles 20 (polypropylene wax powder) are provisionally adhered to each other by polyvinyl alcohol (PVA) adhesive.

(3) The dried paper sheet 12, carrying the coated layer, is heated in an oven for about 15 minutes at a temperature of about 145° C. lower than the melting point (150° C.) of the polypropylene wax powder (PPW-5), and the wax type binder particles 20 (polypropylene wax powder) are peripherally fused to each other. Namely, the wax type binder particles 20 thermally adhere to each other, without being completely melted, as the temperature of 145° C. is somewhat lower than the melting point (150° C.) of the polypropylene wax powder, resulting in production of a third microcapsule layer section 16Y having a rockwork-like structure as shown in FIGS. 1 and 2.

The heating process of thermally adhering the wax type binder particles 20 to each other strengthens the rockwork-like structure of the third microcapsule layer section 16Y. However, when the strength of the rockwork-like structure is adequate after naturally drying the polyvinyl alcohol (PVA) solution or another adhesive solution, the heating process may be omitted.

As mentioned above, since the wax type binder particles 20 are not completely melted, there remain fine clearances or pores in the rockwork-like structure of the third microcapsule layer section 16Y between the binder particles 20, as exaggeratedly shown in FIGS. 1 and 2. Also, in this embodiment, since the microcapsules 18Y have a specific gravity greater than that of the wax type binder particles 20, the microcapsules 18Y are submerged under the wax type binder particles 20 in the rockwork-like structure.

With the above arrangement of the third microcapsule layer section 16Y, as long as the wax type binder particles 20 are solid, i.e. as long as the third microcapsule layer section 16Y is not subjected to a temperature higher than the melting point (150° C.) of the polypropylene wax powder, the microcapsules 18Y cannot be squashed and broken even though a pressure of higher than 0.02 MPa, with a shearing force, is exerted on the third microcapsule layer section 16Y, because the microcapsules 18Y cannot be directly subjected to the breaking pressure due to the existence of the rockwork-like structure of the wax type binder particles 20.

However, when the third microcapsule layer section 16Y is subjected to a temperature higher than the melting point (150° C.) of the polypropylene wax powder, the wax type binder particles 20 melt, and the rockwork-like structure breaks down. Subsequently, when a breaking pressure higher than 0.02 MPa, with a shearing force, is exerted on the third microcapsule layer section 16Y, the microcapsules 18Y are directly subjected to the breaking pressure, resulting in breakage of the microcapsules 18Y.

Figure 3:
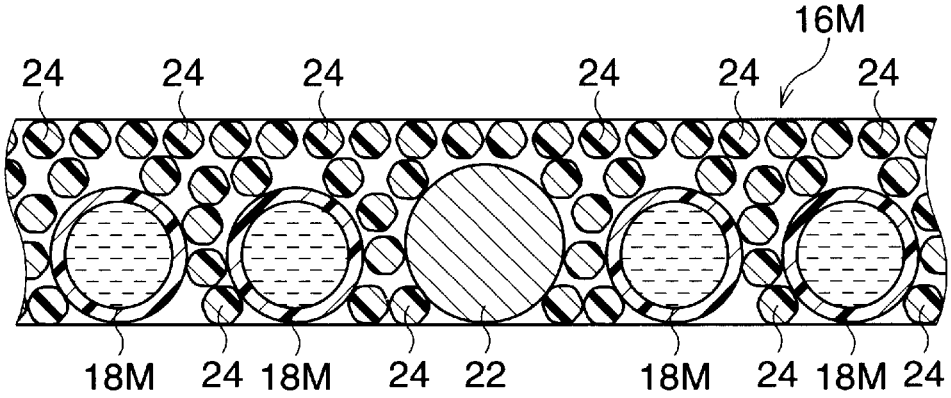
FIG. 3 is an enlarged schematic cross-sectional view of the second microcapsule layer section of the image-forming medium shown in FIG. 1.

As schematically shown in FIGS. 1 and 3, the second microcapsule layer section 16M also has a rockwork-like structure in which a plurality of microcapsules 18M, filled with a magenta ink or dye, and a plurality of spacer particles 22 are uniformly distributed in a rockwork-like arrangement of wax-type binder particles 24.

Similar to the microcapsules 18Y, a shell wall of each microcapsule 18M is formed of a suitable amino resin colored white, and the magenta dye contained in each microcapsule 18M is prepared as a magenta oil dye composed of transparent oil containing about 10 wt. % of magenta pigment. For the transparent oil, KMC-113 is used, and rhodamine lake T is used for the magenta pigment.

The microcapsules 18M can also be produced by the aforesaid polymerization method. The microcapsules 18M have an average diameter of about 6$\mu$ to 7$\mu$, and the shell wall of each microcapsule 18M has a thickness such that each microcapsule 18M is squashed and broken when being subjected to a pressure of higher than about 0.2 MPa, with a shearing force. The spacer particles 22 are formed of hydroxyapatite, and have an average diameter of about 8$\mu$ to 9$\mu$ larger than the average diameter of the microcapsules 18M.

On the other hand, for the wax-type binder particles 24, microcrystalline wax powder, which is available as CWP-3 from SEISHIN K.K., is used. The microcrystalline wax powder (CWP-3) has an average diameter of about 3$\mu$ to 5$\mu$, and has a thermal melting point of about 108° C. Note, the microcrystalline wax powder is colored white.

The rockwork-like of the second microcapsule layer section 16M is produced by the following processes:

(1) 10 g of the microcrystalline wax powder (CWP-3), 10 g of the microcapsules 18M and 5 g of the spacer particles 22 are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The third microcapsule layer section 16Y, previously formed on the paper sheet 12, is coated with the suspension at about 2 g to 4 g per square meter, using a spray gun, and then the coated layer is allowed to naturally dry. When the drying is completed, the wax type binder particles 24 (microcrystalline wax powder) are provisionally adhered to each other by the polyvinyl alcohol (PVA) adhesive.

(3) The dried paper sheet 12 and third microcapsule layer section 16Y carrying the coated layer are heated in the oven for about 15 minutes at a temperature of about 103° C., lower than the melting point (108° C.) of the microcrystalline wax powder (CWP-3), whereby the wax type binder particles 24 (microcrystalline wax powder) are peripherally fused to each other. Namely, the wax type binder particles 24 thermally adhere to each other, without being completely melted, as the heating temperature (103° C.) is somewhat lower than the melting point (108° C.) of the microcrystalline wax powder, resulting in production of a second microcapsule layer section 16M with a rockwork-like structure as shown in FIGS. 1 and 3.

Similar to the third microcapsule layer section 16Y, the heating process for thermally adhering the wax type binder particles 24 to each other strengthens the rockwork-like structure of the second microcapsule layer section 16M. Of course, the heating process may be omitted, if sufficient strength of the rockwork-like structure can be obtained by the polyvinyl alcohol (PVA) or another adhesive.

As mentioned above, since the wax type binder particles 24 are not completely melted, there remain fine clearances or pores in the rockwork-like structure of the second microcapsule layer section 16M between the binder particles 24, as exaggeratedly shown in FIGS. 1 and 3. Also, since the microcapsules 18M and the spacer particles 22 exhibit a specific gravity greater than that of the wax type binder particles 24, the microcapsules 18M and the spacer particles 22 are submerged under the wax type binder particles 24 in the rockwork-like structure.

With this arrangement of the second microcapsule layer section 16M, as long as the wax type binder particles 24 are solid, i.e. as long as the second microcapsule layer section 16M is not subjected to a temperature higher than the melting point (108° C.) of the microcrystalline wax powder, the microcapsules 18M cannot be squashed and broken even though a pressure higher than 0.2 MPa, with a shearing force, is exerted on the second microcapsule layer section 16M, because the microcapsules 18M cannot be directly subjected to the breaking pressure due to the existence of the rockwork-like structure of the wax type binder particles 24.

However, when the second microcapsule layer section 16M is subjected to a temperature higher than the melting point (108° C.) of the microcrystalline wax powder (CWP-3), the wax type binder particles 24 melt, resulting in the breakdown of the rockwork-like structure. Thus, when the pressure of higher than 0.2 MPa, with a shearing force, is exerted on the second microcapsule layer section 16M, the microcapsules 18M are directly subjected to the breaking pressure due to the breakdown of the rockwork-like structure of the wax type binder particles 24, resulting in breakage of the microcapsules 18M.

Note, the function of the spacer particles 22, distributed in the second microcapsule layer section 16M, is explained in detail hereinafter.

Figure 4:
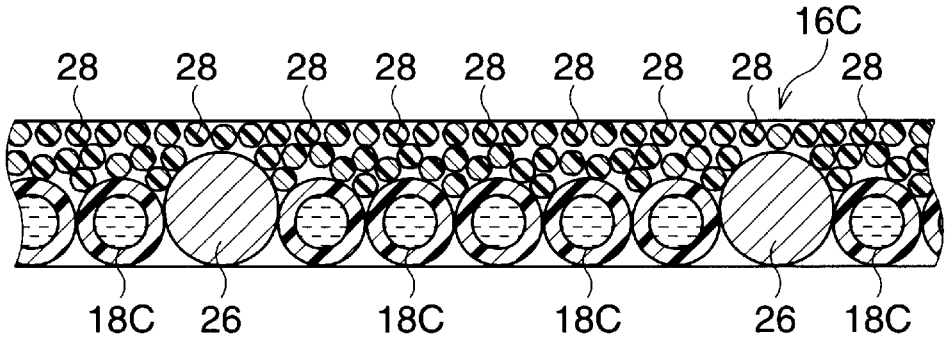
FIG. 4 is an enlarged schematic cross-sectional view of the first microcapsule layer section of the image-forming medium shown in FIG. 1.

As schematically shown in FIGS. 1 and 4, the first microcapsule layer section 16C also has a rockwork-like structure in which a plurality of microcapsules 18C, filled with a cyan ink or dye, and a plurality of spacer particles 26 are uniformly distributed in a rockwork-like arrangement of wax-type binder particles 28.

Similar to the microcapsules 18Y and 18M, a shell wall of each microcapsule 18C is formed of a suitable amino resin colored white, and the cyan dye contained in each microcapsule 18C is prepared as a cyan oil dye composed of transparent oil containing about 10 wt. % of cyan pigment. KMC-113 is used for the transparent oil, and phthalocyanine blue is used for the cyan pigment.

The microcapsules 18C also can be produced by the aforesaid polymerization method. The microcapsules 18C have an average diameter of about 3$\mu$ to 4$\mu$, and the shell wall of each microcapsule 18C has a thickness such that each microcapsule 18C is squashed and broken when being subjected to a pressure of higher than about 2.0 MPa with a shearing force. Also, the spacer particles 26 are formed of hydroxyapatite, and have an average diameter of about 5$\mu$ to 6$\mu$ larger than the average diameter of the microcapsules 18C.

For the wax-type binder particles 28, paraffin wax powder is used. The paraffin wax powder has an average diameter of about 1$\mu$to 3$\mu$, and a thermal melting point of about 73° C. The paraffin wax powder can be obtained by pulverizing paraffin wax material with a suitable jet mill. Note, the paraffin wax powder is colored white.

The rockwork-like structure of the first microcapsule layer section 16C is produced by the following processes:

(1) 10 g of the paraffin wax powder (28), 10 g of the microcapsules 18C and 5 g of the spacer particles 26 are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The microcapsule layer sections 16M and 16Y, formed on the paper sheet 12, are coated with the suspension at about 1 g to 3 g per square meter, using a spray gun, and then the coated layer is allowed to naturally dry. When the drying of the coated layer is completed, the wax type binder particles 28 (paraffin wax powder) are provisionally adhered to each other by the polyvinyl alcohol (PVA) adhesive.

(3) The dried paper sheet 12 and microcapsule layer sections 16M and 16Y carrying the coated layer are heated in the oven for about 15 minutes at a temperature of about 68° C. lower than the melting point (73° C.) of the paraffin wax powder, whereby the wax type binder particles 28 (paraffin wax powder) are peripherally fused to each other. Namely, the wax type binder particles 28 thermally adhere to each other, without being completely melted, as the temperature of 68° C. is somewhat lower than the melting point (73° C.) of the paraffin wax powder, resulting in production of a first microcapsule layer section 16C having the rockwork-like structure as shown in FIGS. 1 and 4.

Similar to the microcapsule layer sections 16M and 16Y, the heating process for thermally adhering the wax type binder particles 28 to each other is provided to strengthen the rockwork-like structure of the first microcapsule layer section 16C. Of course, the heating process may be omitted, if sufficient strength of the rockwork-like structure can be obtained by the polyvinyl alcohol (PVA) adhesive or another adhesive.

Since the wax type binder particles 28 are not completely melted, there remain fine clearances or pores in the rockwork-like structure of the first microcapsule layer section 16C between the binder particles 28, as exaggeratedly shown in FIGS. 1 and 4. Also, since the microcapsules 18C and the spacer particles 26 have a specific gravity larger than that of the wax type binder particles 26, the microcapsules 18C and the spacer particles 26 are submerged under the wax type binder particles 28 in the rockwork-like structure.

With this arrangement of the first microcapsule layer section 16C, as long as the wax type binder particles 28 are solid, i.e. as long as the first microcapsule layer section 16C is not subjected to a heating temperature higher than the melting point (73° C.) of the paraffin wax powder (28), the microcapsules 18C cannot be squashed and broken even though a pressure higher than 2.0 MPa, with a shearing force, is exerted on the first microcapsule layer section 16C, because the microcapsules 18C cannot be directly subjected to the breaking pressure due to the existence of the rockwork-like structure of the wax type binder particles 28.

However, when the first microcapsule layer section 16C is subjected to a temperature higher than the melting point (73° C.) of the paraffin wax powder, the wax type binder particles 28 thermally melt, and the rockwork-like structure of the wax type binder particles 28 breaks down. Thus, when a breaking pressure of higher than 2.0 MPa, with a shearing force, is exerted on the first microcapsule layer section 16C, the microcapsules 18C are directly subjected to the breaking pressure due to the breakdown of the rockwork-like structure of the wax type binder particles 28, resulting in breakage of the microcapsules 18C.

Note, the function of the spacer particles 26, distributed in the first microcapsule layer section 16C, is explained in detail hereinafter.

Figure 5:
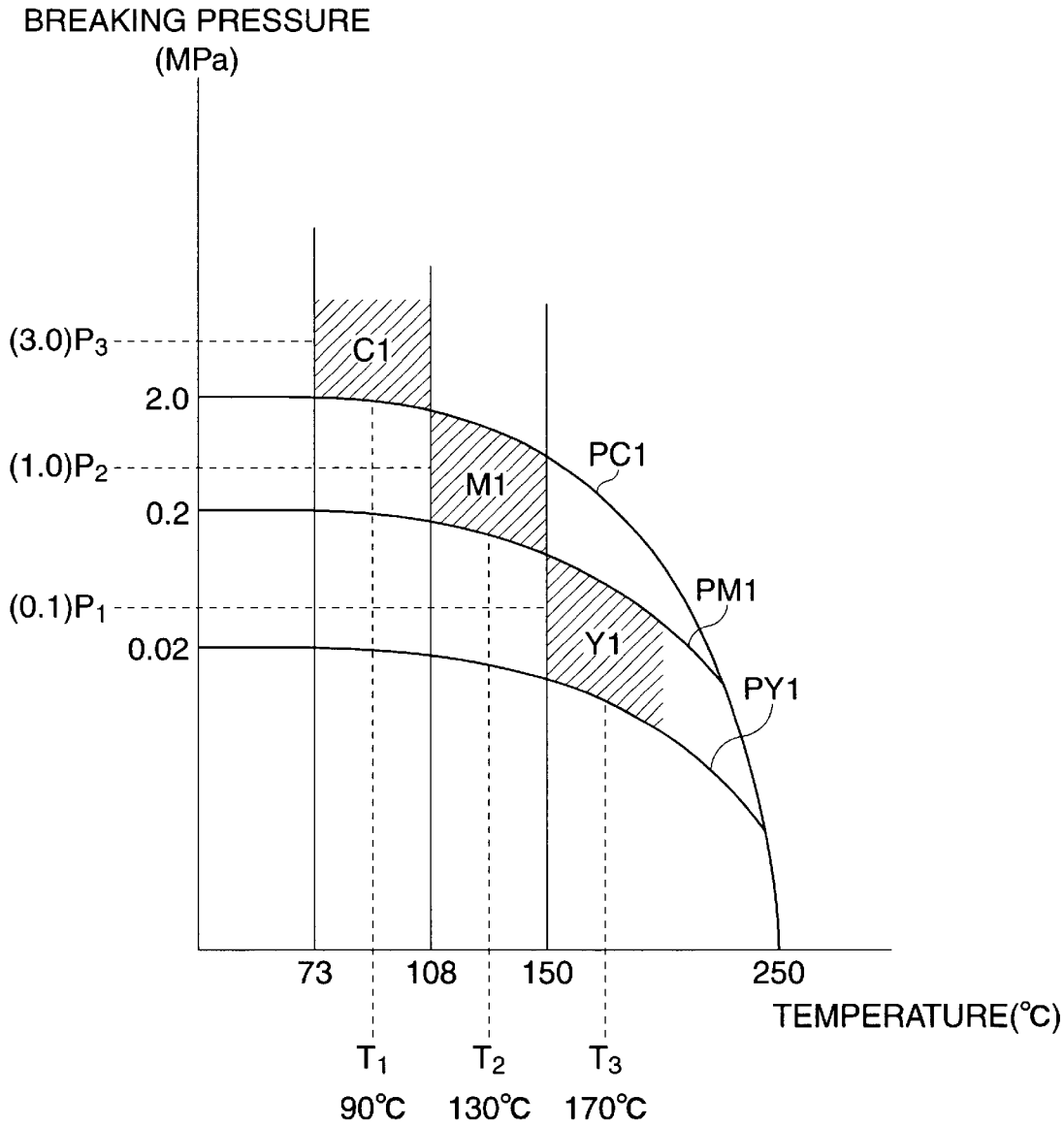
FIG. 5 is a graph showing three-primary color-developing areas defined on the first embodiment of the image-forming medium shown in FIG. 1.

Hence, the respective microcapsules 18C, 18M and 18Y, contained in the first, second and third microcapsule layer sections 16C, 16M and 16Y of the microcapsule layer 14, are squashed and broken in accordance with temperature/pressure breaking characteristics as shown in a graph of FIG. 5.

In the graph of FIG. 5, reference PC1 represents a critical breaking-pressure curve of the cyan microcapsules 18C. As stated above, although the cyan microcapsules 18C are squashed and broken under room temperature while being subjected to a higher pressure than the critical breaking pressure 2.0 MPa, with the shearing force, the critical breaking pressure decreases in accordance with the rise in temperature as represented by the critical breaking-pressure curve PC1.

Also, in the graph of FIG. 5, reference PM1 represents a critical breaking-pressure curve of the magenta microcapsules 18M. Although the magenta microcapsules 18M are squashed and broken under room temperature while being subjected to a higher pressure than the critical breaking pressure 0.2 MPa, with the shearing force, the critical breaking pressure decreases in accordance with the rise in temperature as represented by the critical breaking-pressure curve PM1.

Further, in the graph of FIG. 5, reference PY1 represents a critical breaking-pressure curve of the yellow microcapsules 18Y. Although the yellow microcapsules 18Y are squashed and broken under room temperature while being subjected to a higher pressure than the critical breaking pressure 0.02 MPa, with the shearing force, the critical breaking pressure decreases in accordance with the rise in temperature as represented by the critical breaking-pressure curve PY1.

In the graph of FIG. 5, the temperature/pressure range for squashing and breaking the cyan microcapsules 18C is represented as a hatched cyan-developing area C1 which is defined by the critical breaking-pressure curve PC1, the melting point (73° C.) of the paraffin wax powder (28) and the melting point (108° C.) of the microcrystalline wax powder (24). Also, the temperature/pressure range for squashing and breaking the magenta microcapsules 18M is shown as a hatched magenta-developing area M1 which is defined by the critical breaking-pressure curve PM1, the melting point (108° C.) of the microcrystalline wax powder (24) and the melting point (150° C.) of the polypropylene wax powder (20). Further, the temperature/pressure range for squashing and breaking the yellow microcapsules 18Y is shown as a hatched yellow-developing area Y1 which is defined by the critical breaking-pressure curve PY1 and the melting point (150° C.) of the polypropylene wax powder (20).

Thus, by suitably selecting a heating temperature and a breaking pressure to be locally exerted on the microcapsule layer 14 of the image-forming medium 10, it is possible to selectively squash and break the cyan, magenta and yellow microcapsules 18C, 18M and 18Y at the localized area of the image-forming medium 10 where the temperature and pressure are exerted.

For example, as shown in FIG. 5, if a heating temperature $T_1$ and a breaking pressure $P_3$ are selected to fall within the hatched cyan-developing area C1 and locally exerted on the image-forming medium 10, only the cyan microcapsules 18C will be squashed and broken at the localized area of the image-forming medium 10 on which the heating temperature $T_1$ and the breaking pressure $P_3$ are exerted, resulting in discharge of the cyan dye from the squashed and broken microcapsules 18C.

Also, as shown in FIG. 5, if a heating temperature $T_2$ and a breaking pressure $P_2$ are selected to fall within the hatched magenta-developing area M1 and locally exerted on the image-forming medium 10, only the magenta microcapsules 18M will be squashed and broken at the localized area of the image-forming medium 10 on which the heating temperature $T_2$ and the breaking pressure $P_2$ are exerted, resulting in discharge of the magenta dye from the squashed and broken microcapsules 18M.

Further, as shown in FIG. 5, if a heating temperature $T_3$ and a breaking pressure $P_1$ are selected to fall within the hatched yellow-developing area Y1 and locally exerted on the image-forming medium 10, only the yellow microcapsules 18Y are squashed and broken at the localized area of the image-forming medium 10 on which the heating temperature $T_3$ and the breaking pressure $P_1$ are exerted, resulting in discharge of the yellow dye from the squashed and broken microcapsules 18Y.

Note, in this embodiment, the heating temperatures $T_1$, $T_2$ and $T_3$ may be set as 90° C., 130° C. and 170° C., respectively, and the breaking pressures $P_1$, $P_2$ and $P_3$ may be set as 0.1 MPa, 1.0 MPa and 3.0 MPa, respectively.

Figure 6:
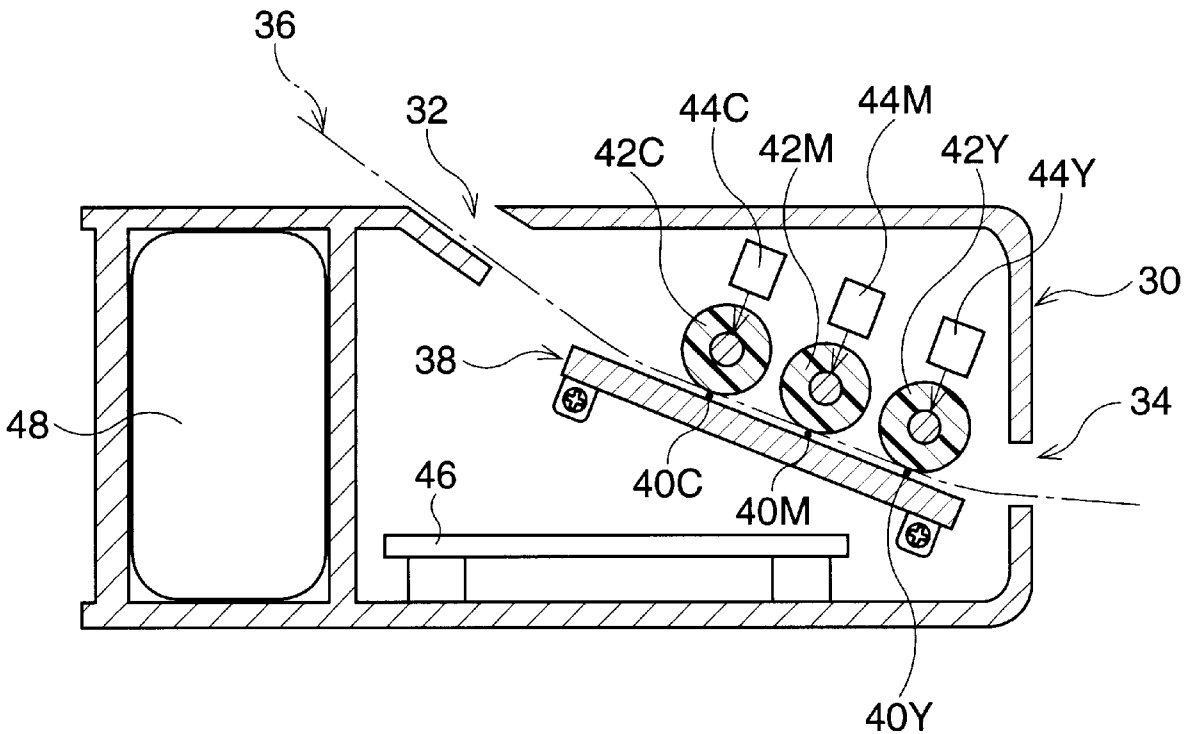
FIG. 6 is a schematic cross-sectional view of a line type color printer for forming a full color image on the image-forming medium shown in FIG. 1.

FIG. 6 schematically shows a color printer, which is constituted as a line printer to form a full color image on the image-forming medium 10.

The color printer comprises a rectangular parallelepiped housing 30 having an entrance opening 32 and an exit opening 34 formed in a top wall and a side wall of the housing 30, respectively. The image-forming medium 10 is introduced into the housing 30 through the entrance opening 32, and is then discharged from the exit opening 34 after the formation of a color image on the image-forming medium 10. Note, in FIG. 6, a path 36 for movement of the image-forming medium 10 is indicated by a single-chained line.

A guide plate 38 is provided in the housing 30 to define a part of the path 36 for the movement of the image-forming medium 10, and a first thermal head 40C, a second thermal head 40M and a third thermal head 40Y are securely attached to a surface of the guide plate 38. Each thermal head (40C, 40M, 40Y) is formed as a line thermal head perpendicularly extended with respect to a direction of the movement of the image-forming medium 10.

Figure 7:
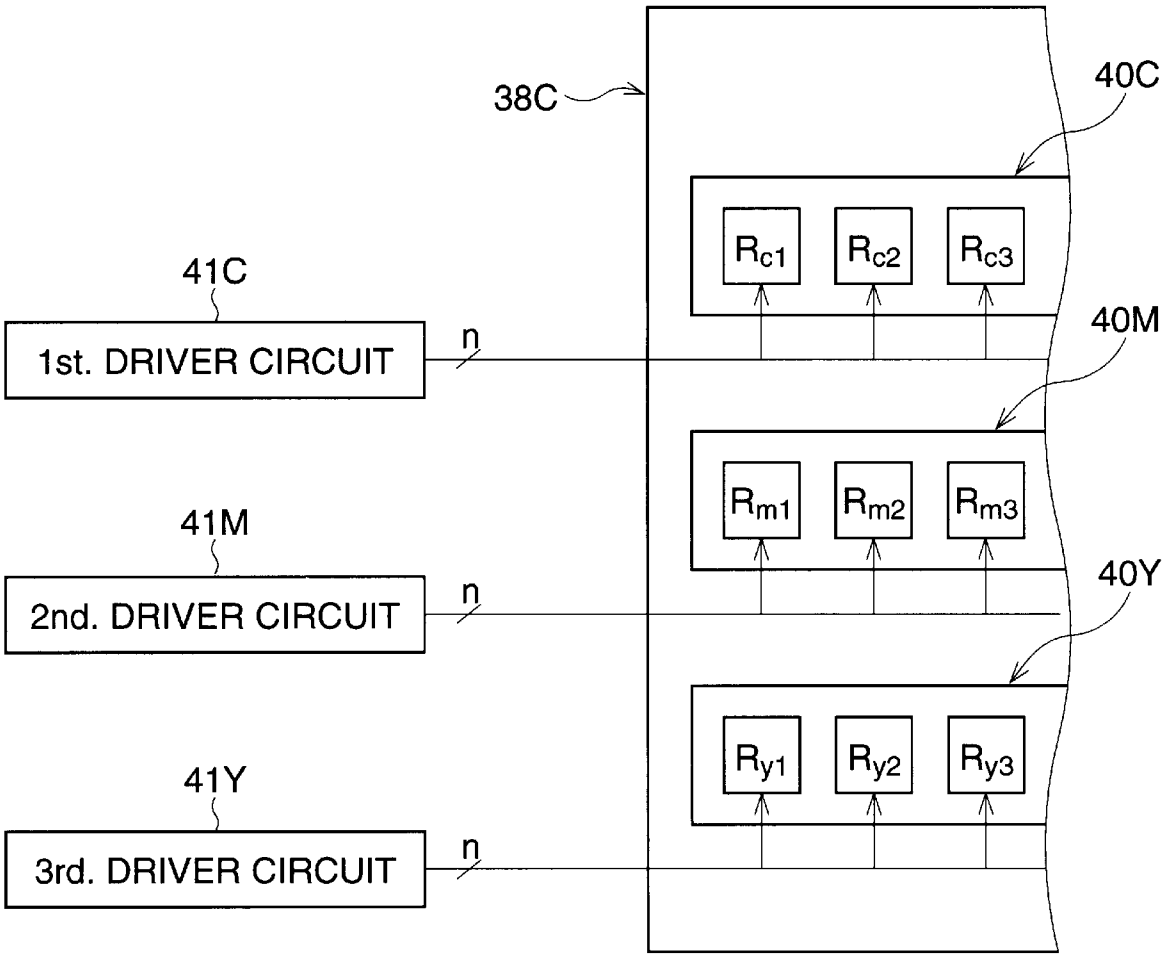
FIG. 7 is a partial schematic block diagram showing first, second and third thermal heads and first, second and third driver circuits therefor, incorporated in the color printer shown in FIG. 6.

As schematically shown in FIG. 7, the line thermal head 40C includes a plurality of heater elements or electric resistance elements $R_{c1}$ to $R_{cn}$ (only the elements $R_{c1}$, $R_{c2}$ and $R_{c3}$ are visible in FIG. 7), and these resistance elements are aligned with each other along a length of the line thermal head 40C. The electric resistance elements $R_{c1}$ to $R_{cn}$ are selectively and electrically energized by a first driver circuit 41C in accordance with a single-line of cyan image-pixel signals, and the electrically-energized elements are heated to the temperature $T_1$ (90° C.) between the melting point (73° C.) of the paraffin wax powder (28) and the melting point (108° C.) of the microcrystalline wax powder (24).

Also, the line thermal head 40M includes a plurality of heater elements or electric resistance elements $R_{m1}$ to $R_{mn}$ (only the elements $R_{m1}$, $R_{m2}$ and $R_{m3}$ are visible in FIG. 7), and these resistance elements are aligned with each other along a length of the line thermal head 40M. The electric resistance elements $R_{m1}$ to $R_{mn}$ are selectively and electrically energized by a second driver circuit 41M in accordance with a single-line of magenta image-pixel signals, and the electrically-energized elements are heated to the temperature $T_2$ (130° C.) between the melting point (108° C.) of the microcrystalline wax powder (24) and the melting point (150° C.) of the polypropylene wax powder (20).

Further, the line thermal head 40Y includes a plurality of heater elements or electric resistance elements $R_{y1}$ to $R_{yn}$ (only the elements $R_{y1}$, $R_{y2}$ and $R_{y3}$ are visible in FIG. 7), and these resistance elements are aligned with each other along a length of the line thermal head 40Y. The electric resistance elements $R_{y1}$ to $R_{yn}$ are selectively and electrically energized by a third driver circuit 41Y in accordance with a single-line of yellow image-pixel signals, and the electrically-energized elements are heated to the temperature $T_3$ (170° C.) higher than the melting point (150° C.) of the polypropylene wax powder (20).

The electric resistance elements $R_{c1}$ to $R_{cn}$, the electric resistance elements $R_{m1}$ to $R_{mn}$ and the electric resistance elements $R_{y1}$ to $R_{yn}$ are arranged in a 3×n matrix manner, and the three electric resistance elements ($R_{cn}$, $R_{mn}$ and $R_{yn}$) included in each column are aligned with each other, as shown in FIG. 7.

Note, in the color printer shown in FIG. 6, the line thermal heads 40C, 40M and 40Y are arranged in sequence so that the respective heating temperatures increase in the direction of movement of the image-forming medium 10.

The color printer further comprises a first roller platen 42C, a second roller platen 42M and a third roller platen 42Y associated with the first, second and third thermal heads 40C, 40M and 40Y, respectively, and each of the roller platens 42C, 42M and 42Y may be formed of a suitable hard rubber material. The first roller platen 42C is provided with a first spring-biasing unit 44C so as to be elastically pressed against the first thermal head 40C at the breaking-pressure $P_3$ (3.0 MPa), higher than the critical breaking-pressure 2 MPa; the second roller platen 42M is provided with a second spring-biasing unit 44M so as to be elastically pressed against the second thermal head 40M at the breaking-pressure $P_2$ (1.0 MPa) between the critical breaking-pressures 0.2 MPa and 2.0 MPa; and the third roller platen 42Y is provided with a third spring-biasing unit 44Y so as to be elastically pressed against the third thermal head 40Y at the breaking-pressure $P_1$ (0.1 MPa) between the critical breaking-pressures 0.02 MPa and 0.2 MPa.

Note, the roller platens 42C, 42M and 42Y are arranged in sequence so that the respective pressures, exerted by the roller platens 42C, 42M and 42Y, decrease in the direction of movement of the image-forming medium 10.

In FIG. 6, reference 46 indicates a control circuit board for controlling a printing operation of the color printer, and reference 48 indicates an electrical main power source for electrically energizing the control circuit board 46 including the first, second and third driver circuits 41C, 41M and 41Y.

During the printing operation, the respective roller platens 42C, 42M and 42Y are rotated in a counterclockwise direction (FIG. 6) by three motors (not shown), respectively, with a same peripheral speed under control of the control circuit board 46, so that the image-forming medium 10, introduced into the entrance opening 32, moves toward the exit opening 34 along the path 36. Note, the control circuit board 46 includes a driver circuit for the motors of the roller platens 42C, 42M and 42Y. The introduction of the image-forming medium 10 is performed such that the microcapsule layer 14 is in direct contact with the thermal heads 40C, 40M and 40Y.

While the image-forming medium 10 passes between the first thermal head 40C and the first roller platen 42C without all the electric resistance elements $R_{c1}$ to $R_{cn}$ being energized, the microcapsule layer 14 of the image-forming medium 10 is subjected to the breaking-pressure $P_3$ (3.0 MPa) with the shearing force from each electric resistance element ($Rc_1$, . . . , $R_{cn}$) of the first thermal head 40C. Nevertheless, the breaking-pressure $P_3$ with the shearing force cannot be exerted on the cyan microcapsules 18C due to the existence of the rockwork-like structure of the first microcapsule layer section 16C.

Figure 8:
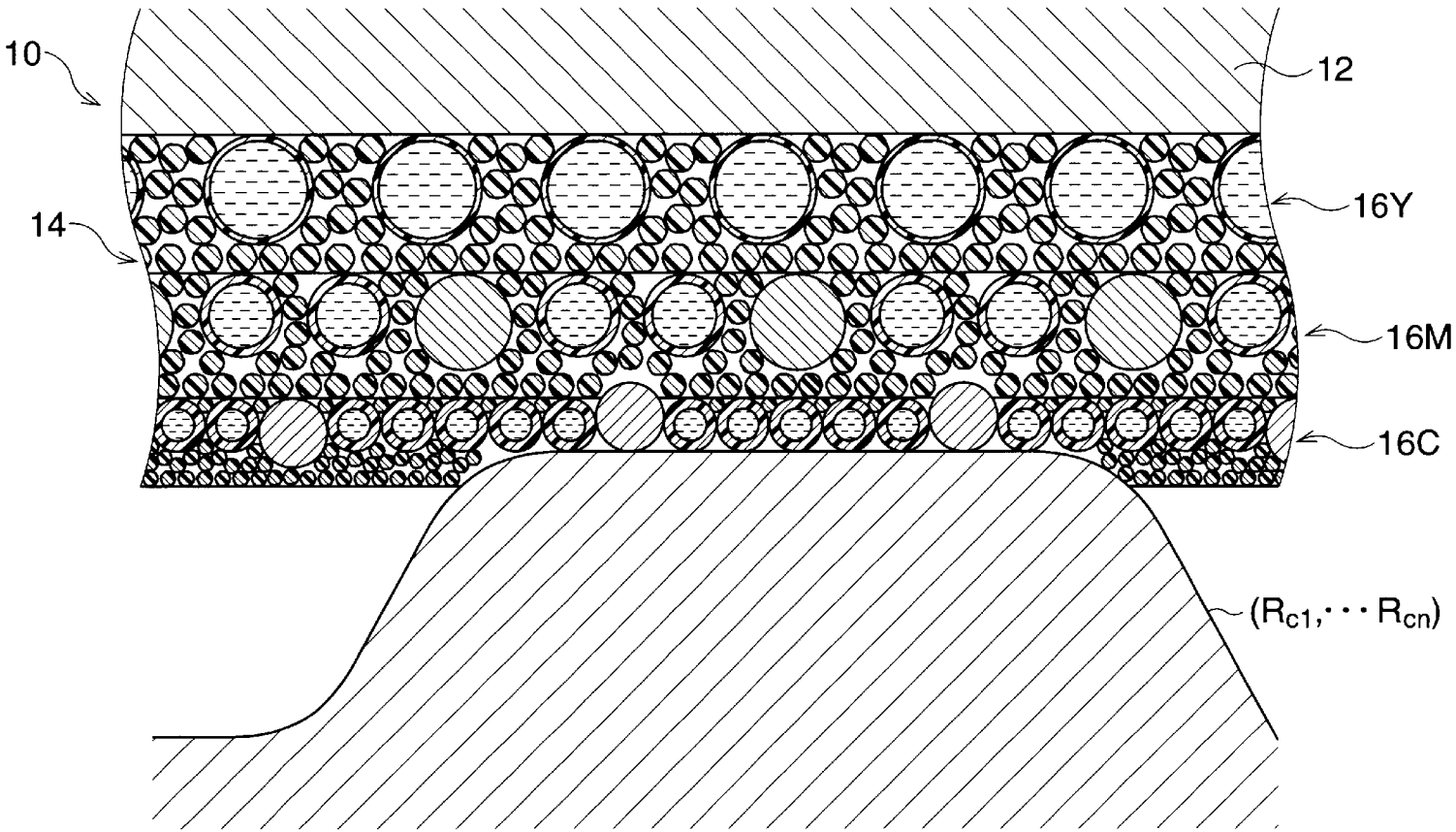
FIG. 8 is a schematic cross-sectional view showing penetration of an electric resistance element of the first thermal head in the first microcapsule layer section to thereby develop a cyan dot on the image-forming medium shown in FIG. 1.

However, when any one of the electric resistance elements $R_{c1}$ to $R_{cn}$ is electrically energized to be heated to the temperature $T_1$ (90° C.) higher than the melting point 73° C. of the paraffin wax powder (28), the heated electric resistance element ($Rc_1$, . . . , $R_{cn}$) penetrates into the first microcapsule layer section 16C, as shown in FIG. 8 by way of example, because a portion of the rockwork-like structure of the first microcapsule layer section 16C, to which the heated element ($R_{c1}$, . . . , $R_{cn}$) is applied, is thermally melted and collapsed. Thus, the cyan microcapsules 18C, included in the collapsed portion of the rockwork-like structure and directly subjected to the breaking-pressure $P_3$ (3.0 MPa), with the shearing force, from the heated element ($R_{c1}$, . . . , $R_{cn}$), are squashed and broken, resulting in discharge of the cyan dye from the broken microcapsules 18C. In short, a cyan dot is produced on the microcapsule layer 14 of the image-forming medium 10 by the heated element ($R_{c1}$, . . . , $R_{cn}$).

Note, in FIG. 8, although the molten paraffin wax is not shown to avoid complication of illustration, it is absorbed into the fine clearances or pores of the rockwork-like structures of the first and second microcapsule layer sections 16C and 16M.

While the image-forming medium 10 passes between the second thermal head 40M and the second roller platen 42M without all the electric resistance elements $R_{m1}$ to $R_{mn}$ being energized, the microcapsule layer 14 of the image-forming medium 10 is subjected to the breaking-pressure $P_2$ (1.0 MPa) with the shearing force from each electric resistance element ($R_{m1}$, . . . , $R_{mn}$) of the second thermal head 40M. Nevertheless, the breaking-pressure $P_2$ with the shearing force cannot be exerted on the magenta microcapsules 18M due to the existence of the rockwork-like structures of the first and second microcapsule layer sections 16C and 16M.

Figure 9:
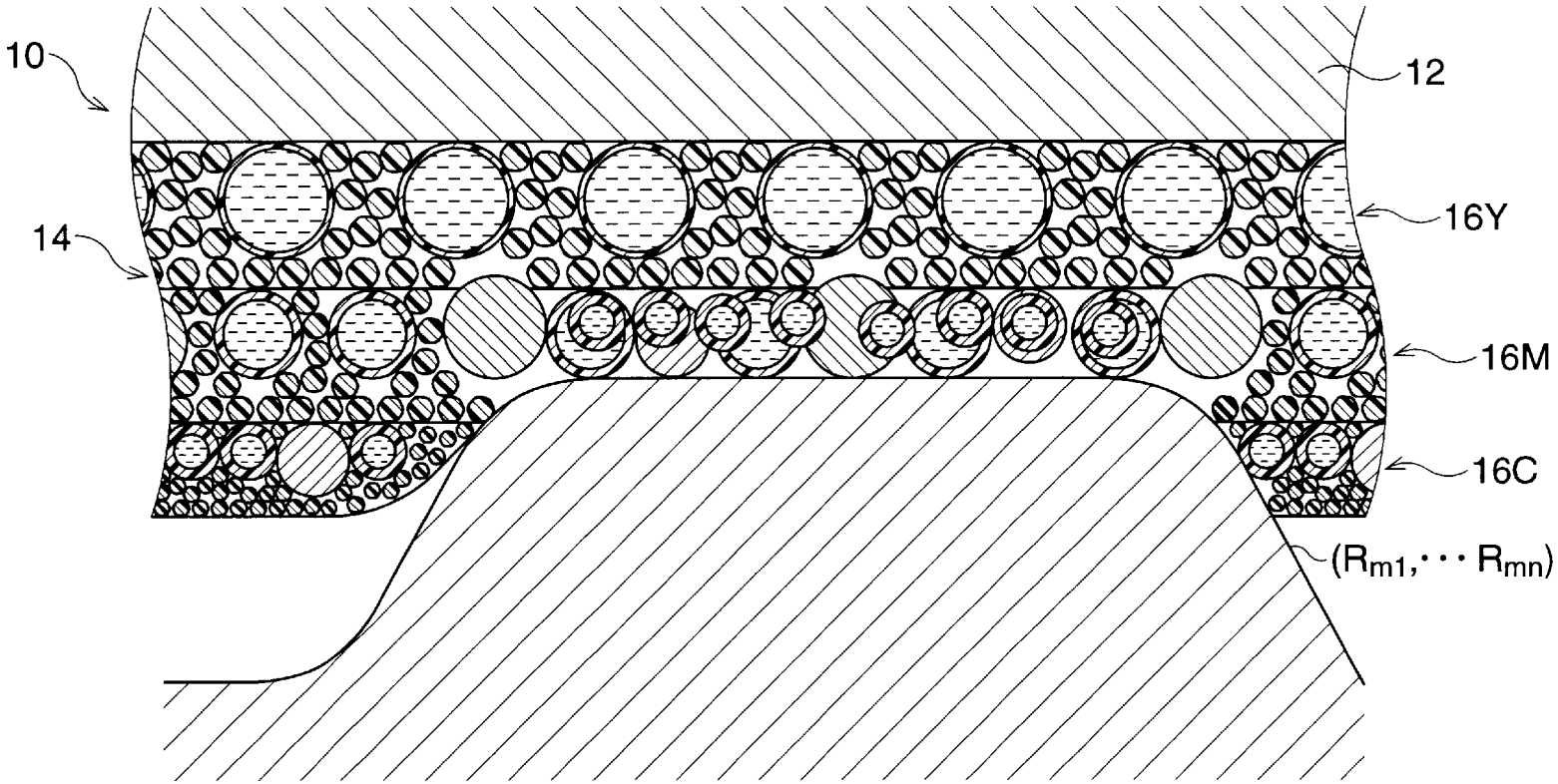
FIG. 9 is a schematic cross-sectional view showing penetration of an electric resistance element of the second thermal head in the first and second microcapsule layer sections to thereby develop a magenta dot on the image-forming medium shown in FIG. 1.

However, when any one of the electric resistance elements $R_{m1}$ to $R_{mn}$ is electrically energized to be heated to the temperature $T_2$ (130° C.) higher than the melting point (73° C.) of the paraffin wax powder (28) and the melting point (108° C.) of the microcrystalline wax powder (24), the heated electric resistance element ($R_{m1}$, . . . , $R_{mn}$) penetrates into the first and second microcapsule layer sections 16C and 16M, as shown in FIG. 9, because a portion of the rockwork-like structures of the first and second microcapsule layer sections 16C and 16M, to which the heated element ($R_{m1}$, . . . , $R_{mn}$) is applied, is thermally melted and collapsed. Thus, the cyan and magenta microcapsules 18C and 18M, included in the collapsed portion of the rockwork-like structures, are directly subjected to the breaking-pressure $P_2$ (1.0 MPa), with the shearing force, from the heated element ($R_{m1}$, . . . , $R_{mn}$).

At this time, the cyan microcapsules 18C are impervious to the breaking-pressure $P_2$ with the shearing force. Thus, only the magenta microcapsules 18M are squashed and broken, resulting in discharge of the magenta dye from the broken microcapsules 18M. In short, a magenta dot is produced on the microcapsule layer 14 of the image-forming medium 10 by the heated element ($R_{m1}$, . . . , $R_{mn}$).

Note, in FIG. 9, although the molten wax is not shown to avoid complication of illustration, it is absorbed into the fine clearances or pores of the rockwork-like structures of the first and second microcapsule layer sections 16C and 16M.

While the image-forming medium 10 passes between the third thermal head 40Y and the third roller platen 42Y without all the electric resistance elements $R_{y1}$ to $R_{yn}$ being energized, the microcapsule layer 14 of the image-forming medium 10 is subjected to the breaking-pressure $P_1$ (0.1 MPa) with the shearing force from each electric resistance element ($R_{y1}$, . . . , $R_{yn}$) of the third thermal head 40Y. Nevertheless, the breaking-pressure $P_1$ with the shearing force cannot be exerted on the yellow microcapsules 18Y due to the existence of the rockwork-like structures of the first, second and third microcapsule layer sections 16C, 16M and 16Y.

Figure 10:
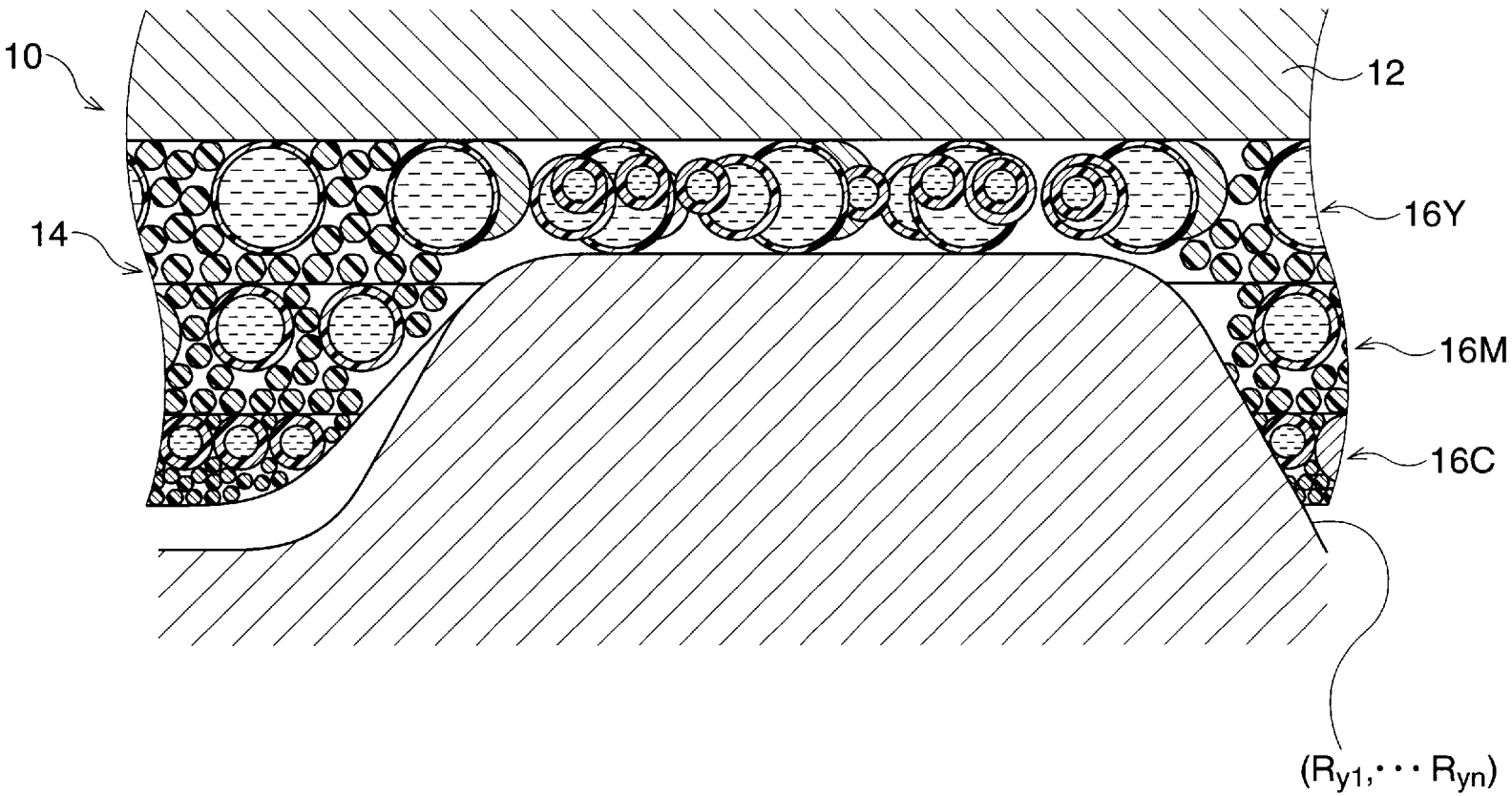
FIG. 10 is a schematic cross-sectional view showing penetration of an electric resistance element of the third thermal head in the first, second and third microcapsule layer sections to thereby develop a yellow dot on the image-forming medium shown in FIG. 1.

However, when any one of the electric resistance elements $R_{y1}$ to $R_{yn}$ is electrically energized to be heated to the temperature $T_1$ (170° C.) higher than the melting point (73° C.) of the paraffin wax powder (28), the melting point (108° C.) of the microcrystalline wax powder (24) and the melting point (150° C.) of the polypropylene wax powder (20), the heated electric resistance element ($R_{y1}$, . . . , $R_{yn}$) penetrates into the first, second and third microcapsule layer sections 16C, 16M and 16Y, as shown in FIG. 10, because a portion of the rockwork-like structures of the first, second and third microcapsule layer sections 16C, 16M and 16Y, to which the heated element ($R_{y1}$, . . . , $R_{yn}$) is applied, is thermally melted and collapsed. Thus, the cyan, magenta and yellow microcapsules 18C, 18M and 18Y, included in the collapsed portion of the rockwork-like structures, are directly subjected to the breaking-pressure $P_1$ (0.1 MPa), with the shearing force, from the heated element ($R_{y1}$, . . . , $R_{yn}$).

At this time, the cyan and magenta microcapsules 18C and 18M are impervious to the breaking-pressure $P_1$ with the shearing force. Thus, only the yellow microcapsules 18Y are squashed and broken, resulting in discharge of the yellow dye from the broken microcapsules 18Y. In short, a yellow dot is produced on the microcapsule layer 14 of the image-forming medium 10 by the heated electric resistance element ($R_{y1}$, . . . , $R_{yn}$).

Note, in FIG. 10, although the molten wax is not shown to avoid complication of illustration, it is absorbed into the fine clearances or pores of the rockwork-like structures of the first, second and third microcapsule layer sections 16C, 16M and 16Y and in fine clearances or pores of the paper sheet 12.

As already stated, the respective electric resistance elements $R_{c1}$ to $R_{cn}$, $R_{m1}$ to $R_{mn}$ and $R_{y1}$ to $R_{yn}$ are selectively energized in accordance with a single-line of cyan image-pixel signals, a single-line of magenta image-pixel signals and a single-line of yellow image-pixel signals, whereby a full color image is formed on the microcapsule layer 14 of the image-forming medium 10 by combinations of cyan, magenta and yellow dots produced thereon. Of course, as is well known, in the formation of the full color image, a blue dot is obtained by a combination of a cyan dot and a magenta dot; a green dot is obtained by a combination of a cyan dot and a yellow dot; a red dot is obtained by a combination of a magenta dot and a yellow dot; and a black dot is obtained by a combination of a cyan dot, a magenta dot and a yellow dot.

Note, a dot size (diameter) of the cyan, magenta and yellow dots corresponds to a size of the electric resistance elements $R_{c1}$ to $R_{cn}$, $R_{m1}$ to $R_{mn}$ and $R_{y1}$ to $R_{yn}$, and may be about 50$\mu$ to 100$\mu$.

The function of the spacer particles 26, included the first microcapsule layer section 16C, is now explained below.

The first microcapsule layer section 16C may include cyan microcapsules exceptionally having a larger diameter than the average diameter (3$\mu$ to 4$\mu$) of the cyan microcapsules 18C. The large-sized cyan microcapsules are more susceptible to breakage in comparison with the cyan microcapsules with an average diameter, and may be uncontrollably and undesirably squashed and broken. Especially, undesirable breakage of the large-sized cyan microcapsules is apt to occur when producing a magenta dot on the microcapsule layer 14 of the image-forming medium 10. However, it is possible to effectively prevent the undesirable breakage of the large-sized cyan microcapsules due to the existence of the spacer particles 26 in the first microcapsule layer section 16C.

In particular, as mentioned above, when any one of the electric resistance elements $R_{m1}$ to $R_{mn}$ is electrically energized to produce a magenta dot on the microcapsule layer 14 of the image-forming medium 10, the heated electric resistance element penetrates into the first and second microcapsule layer sections 16C and 16M (FIG. 9). In this case, of course, the penetration of the heated element into the rockwork-like structure of the first microcapsule layer section 16C is prior to penetration of the heated element into the rockwork-like structure of the second microcapsule layer section 16M.

In the penetration of the heated element into the rockwork-like structure of the first microcapsule layer section 16C, if there are no spacer particles 26 in the first microcapsule layer section 16C, the large-sized cyan microcapsules are concentrically subjected to the breaking-pressure $P_2$ (1.0 MPa) with the shearing force, and thus may be broken, resulting in discharge of the cyan dye from the broken microcapsules. However, in reality, the large-sized cyan microcapsules can be prevented from being concentrically subjected to the breaking-pressure $P_2$ with the shearing force, due to the existence of the spacer particles 26 in the first microcapsule layer section 16C, and thus the large-sized cyan microcapsules cannot be uncontrollably and undesirably squashed and broken.

Note, of course, when a cyan dye is discharged by the undesirable breakage of the large-sized cyan microcapsules, the discharged cyan dye appears as noise on the microcapsule layer 14 of the image-forming medium 10, resulting in the deterioration of the full color image formed thereon.

The second microcapsule layer section 16M includes the spacer particles 22 for the same purpose as mentioned above. In particular, the second microcapsule layer section 16M may include magenta microcapsules exceptionally having a larger diameter than the average diameter (6$\mu$ to 7$\mu$) of the magenta microcapsules 18C. The large-sized magenta microcapsules are more susceptible to breakage in comparison with the magenta microcapsules with an average diameter, and may be uncontrollably and undesirably squashed and broken. Especially, the undesirable breakage of the large-sized magenta microcapsules is apt to occur when producing a yellow dot on the microcapsule layer 14 of the image-forming medium 10. However, it is possible to effectively prevent the undesirable breakage of large-sized magenta microcapsules due to the existence of the spacer particles 22 in the second microcapsule layer section 16M, for substantially the same reasons as mentioned above.

In the first embodiment, the respective average diameters of the microcapsules 18C, 18M and 18Y becomes larger in sequence as the respective breaking-pressures $P_3$, $P_2$ and $P_1$ of the microcapsules 18C, 18M and 18Y becomes smaller. This positively contributes towards preventing erroneous breakage of the microcapsules 18C, 18M and 18Y. For example, when the yellow microcapsules 18Y with a maximum average diameter are squashed and broken (FIG. 10), the cyan and microcapsules 18C and 18M with average diameters smaller than the maximum average diameter of the yellow microcapsules 18Y, are prevented from being subjected to the breaking-pressure $P_3$ with the shearing force, and thus can be positively escaped from the erroneous breakage.

In the aforesaid embodiment, another transparent liquid-phase vehicle, exhibiting a high-boiling point, may be substituted for the transparent oil (KMC-113) for preparing the cyan dye, the magenta dye and the yellow dye. Further, a low-melting-point wax, which is completely melted at a temperature lower than the minimum developing-temperature $T_1$ (90° C.), maybe utilized as a vehicle for each of the cyan, magenta and yellow pigments. Of course, in this case, although each of the cyan, magenta and yellow dyes, which is encapsulated in a corresponding microcapsule (18C, 18M, 18Y) exhibits a solid-phase at room temperature, the solid-phase of the encapsulated dye is changed to a liquid-phase when being heated by energization of an electric resistance element of a thermal head (40C, 40M, 40Y).

Also, although the respective polypropylene wax powder, microcrystalline wax powder and paraffin wax are used for the wax-type binder particles 20, 24 and 28, these may be replaced with another type of low-melting wax provided that it exhibits a given melting point. For example, as the low-melting wax, montan wax, carnauba wax, olefin wax or the like may be utilized. Optionally, low-melting thermoplastic resins, such as ethylene-vinyl acetate copolymer (EVA), polyethylene, polyester, polymethyl methacrylate copolymer or the like may be utilized for the wax-type binder particles 20, 24 and 28, provided that each thermoplastic resin exhibits a given melting-point.

Further, although the shell wall of the microcapsules 18C, 18M and 18Y are formed of amino resin (thermosetting resin), a suitable high-melting thermoplastic resin, such as polyamide resin, polyimide resin or the like, may be utilized for the shell wall of the microcapsules provided that the thermoplastic resin cannot be thermally plasticized at a temperature of 250° C. On the other hand, although the spacer particles 22 and 26 are formed of hydroxyapatite, another type of inorganic material, such as silica, calcium carbonate, titanium dioxide or the like, may be utilized for the spacer particles 22 and 26. Optionally, the spacer particles 22 and 26 may be formed of a suitable plastic material, such as, polyamide resin, polyimide resin, polycarbonate resin, Teflon or the like.

In the aforesaid embodiment, various additives may be added to each of the first, second and third microcapsule layer sections 16C, 16M and 16Y. For example, an anti-sticking substance may be added to the microcapsule layer sections to thereby prevent the thermal heads 40C, 40M and 40Y from a sticking of the discharged dyes and molten wax thereon. Also, a fixing substance may be added to the microcapsule layer sections to thereby facilitate fixing the discharged dyes on the paper sheet 12. Further, an ultraviolet absorber and an antioxidant may be added to the microcapsule layer sections to prevent the formed full color image from deteriorating.

Although each of the first, second and third microcapsule layer sections 16C, 16M and 16Y is formed as having the rockwork-like structure of the wax-type binder particles (20, 24, 28), each microcapsule layer section (16C, 16M, 16Y) may be constituted as a solid-phase wax binder layer section in which the microcapsules (18C, 18M, 18Y) are uniformly distributed.

For example, in order to form the third microcapsule layer section as the solid-phase wax binder layer section on the sheet paper 12, 20 g of the polypropylene wax powder (PPW-5) and 10 g of the microcapsules 18Y are mixed with 100 g of 3 wt. % aqueous solution of polyvinyl alcohol (PVA) exhibiting a polymerization degree of 2000, containing a small quantity of dispersant (such as dodecyl benzenesulfonic sodium or the like), and the mixture is agitated to prepare a suspension. Then, the paper sheet 12 is coated with the prepared suspension at about 5 g per square meter, using a spray gun, and then the coated layer is allowed to naturally dry. After the drying of the coated layer is completed, the paper sheet 12 carrying the coated layer is heated in the oven at a temperature somewhat higher than the melting point (150° C.) of the polypropylene wax powder (PPW-5), whereby the wax type binder particles 20 (polypropylene wax powder) included in the coated layer are completely fused, so that the third microcapsule layer section 16Y is formed as the solid-phase wax binder layer section.

Note, when the third microcapsule layer section 16Y is formed as a rockwork-like structure, 10 g of the polypropylene wax powder (PPW-5) is used. However, when the third microcapsule layer section 16Y is formed as a solid-phase wax binder layer section, 20 g of the polypropylene wax powder (PPW-5) is used. This is because fine clearance or pores are eliminated from the solid-phase wax binder layer section.

Of course, it is possible to form each of the second and first microcapsule layer sections 16M and 16C as a solid-phase wax binder layer section in substantially the same manner as the third microcapsule layer section 16Y.

In the aforesaid embodiment, suitable leuco-dyes or leuco-compounds may be substituted for the cyan pigment (phthalocyanine blue), magenta pigment (rhodamine lake T) and yellow pigment (benzine yellow G). As is well-known, a leuco-dye or leuco-compound per se exhibits no color. Namely, usually, the leuco-dye or leuco-compound exhibits milky-white or transparency, and reacts with a color developer, such as zinc salicylate, active white clay and so on, to thereby produce a given single-color (cyan, magenta, yellow). Thus, the color developer must be contained in the first, second and third microcapsule layer sections 16C, 16M and 16Y when using the leuco-dyes or leuco-compounds.

For example, either benzoyl leucomethylene blue (BLMB) or crystal violet lactone (CVL) may be utilized as a cyan-producing leuco-dye or leuco-compound. Also, either R-500, available from YAMADA CHEMICAL K.K., or Red-3, available from YAMAMOTO KASEI K.K., may be utilized as a magenta-producing leuco-dye or leuco-compound. Further either IR-3, available from CIBA SPECIALTY CHEMICALS, or F color Yellow 17, available from YAMAMOTO KASEI K.K., may be utilized as a yellow-producing leuco-dye or leuco-compound.

Note, when the leuco-dyes or leuco-compounds are used, preferably, the shell wall of each microcapsule (18C, 18M, 18Y) is formed of a transparent amino resin, because it is unnecessary to take a coloring of the shell wall into consideration in accordance with a color of the sheet paper 12.

In the aforesaid embodiment, although the microcapsule layer 14 has a three-ply structure composed of the first, second and third microcapsule layer sections 16C, 16M and 16Y for forming a full color image thereon, the microcapsule layer 14 may be constituted as either a single-ply structure or a two-ply structure, if necessary. Of course, when the microcapsule layer 14 has a single-ply structure, a monochromatic image can be formed thereon, and when the microcapsule layer 14 has the two-ply structure, a color image obtained from combination of two colors is formed thereon.

Figure 11:
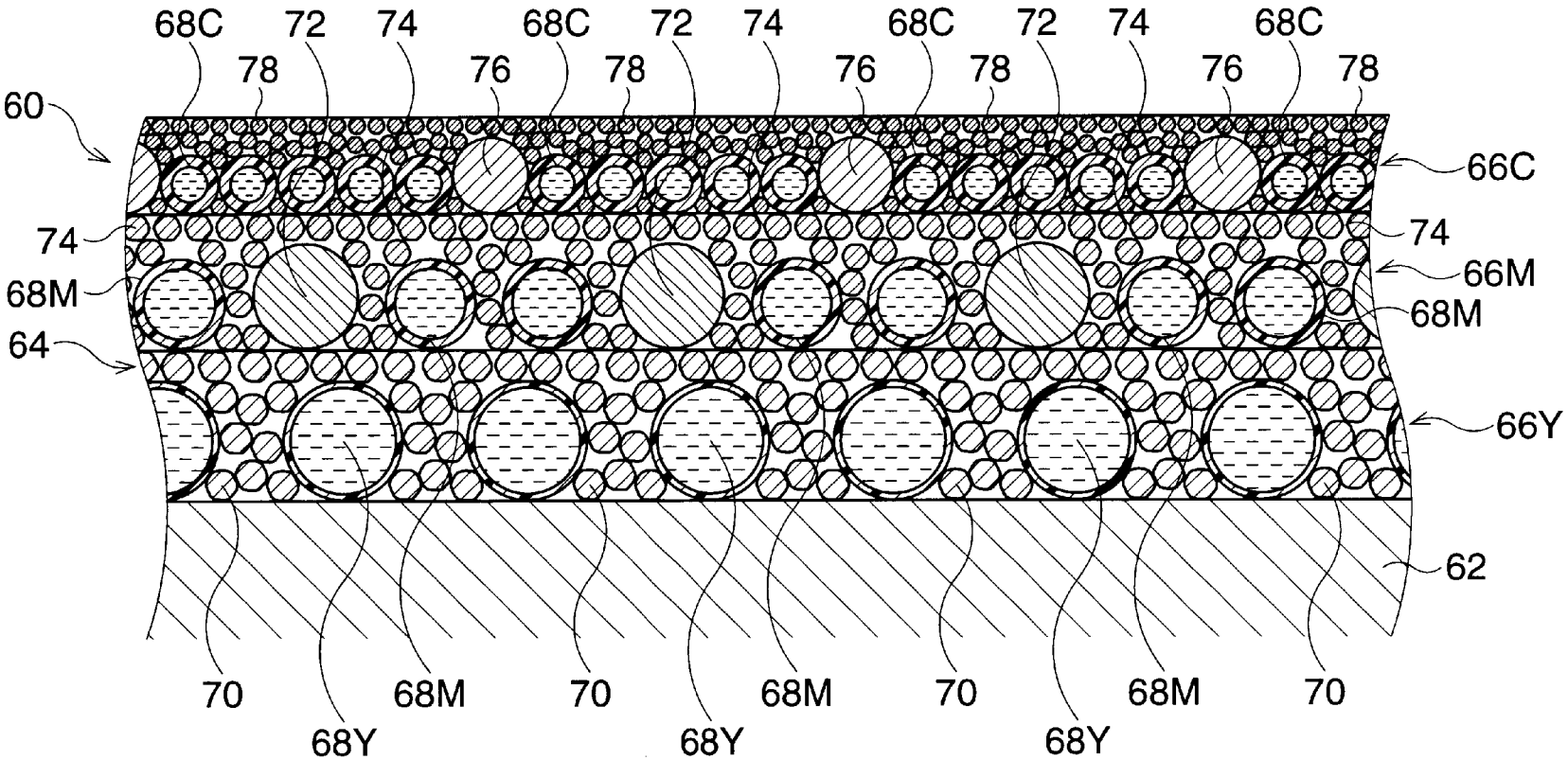
FIG. 11 is a schematic conceptual cross-sectional view showing a second embodiment of the image-forming medium, according to the present invention, coated with a layer of microcapsules including first, second and third microcapsule layer sections for forming a full color image thereon.

FIG. 11 schematically shows a second embodiment of an image-forming medium, generally indicated by reference numeral 60, according to the present invention. The image-forming medium 60 also comprises a sheet-like substrate, such as a sheet of paper 62, and a layer of microcapsule 64 formed thereon. Similar to the first embodiment, the microcapsule layer 64 has a three-ply structure for forming a full color image thereon. In particular, the microcapsule layer 64 includes a first microcapsule layer section 66C for forming a cyan image, a second microcapsule layer section 66M for forming a magenta image, and a third microcapsule layer section 66Y for forming a yellow image. In the production of the image-forming medium 60, first, the third microcapsule layer section 66Y is formed on the paper sheet 62, the second microcapsule layer section 66M is formed on the third microcapsule layer section 66Y, and the first microcapsule layer section 66C is formed on the second microcapsule layer section 66M.

Figure 12:
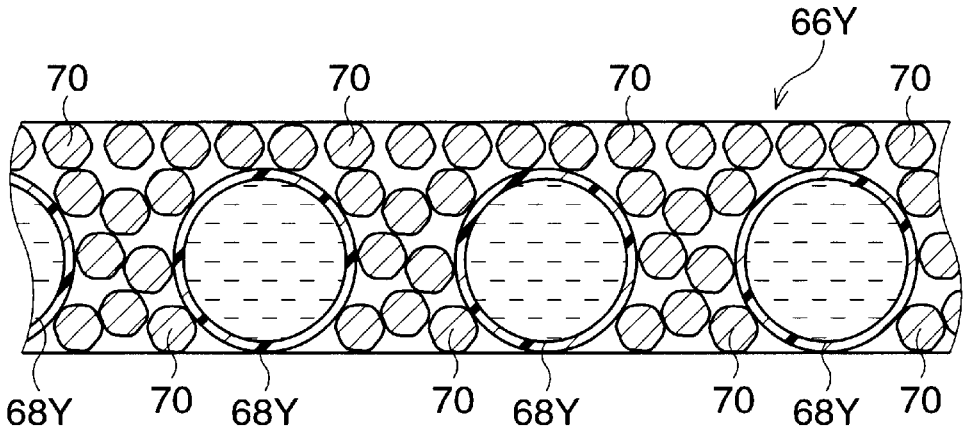
FIG. 12 is an enlarged schematic cross-sectional view of the third microcapsule layer section of the image-forming medium shown in FIG. 11.

As shown in FIGS. 11 and 12, the third microcapsule layer section 66Y has a structure in which a plurality of microcapsules 68Y, filled with a yellow ink or dye based on a yellow-producing leuco-dye or leuco-compound, are uniformly distributed in a rockwork-like arrangement of color developer particles 70.

A shell wall of each microcapsule 68Y is preferably formed of a suitable transparent amino resin (thermosetting resin). Note, the amino resin may be colored with a same color (usually white) as the paper sheet 62, if necessary. The yellow dye contained in each microcapsule 68Y is prepared as an oil dye composed of transparent oil containing about 8 wt. % of a yellow-producing leuco-dye or leuco-compound. For the transparent oil, 2,7-di-isopropyl naphthalene, exhibiting a boiling point of about 300° C., which is available as KMC-113 from Rutgers Kureha Solvents (RKS) GmbH, is used, and for the yellow-producing leuco-dye or leuco-compound, I-3R, available from CIBA SPECIALTY CHEMICALS, is used.

The microcapsules 68Y can be produced by the aforesaid polymerization method. The microcapsules 68Y have an average diameter of about 9$\mu$ to 10$\mu$, and the shell wall of each microcapsule 68Y has a thickness such that each microcapsule 68Y is squashed and broken when being subjected to a pressure higher than about 0.02 MPa, with a shearing force.

For the developer particles 70, isopropylidenebisphenol (bisphenol A) powder is used. The bisphenol A powder has an average diameter of about 3$\mu$ to about 5$\mu$, and is colored white.

Note, the bisphenol A has a thermal melting point of about 156° C., and features the following structural formula:

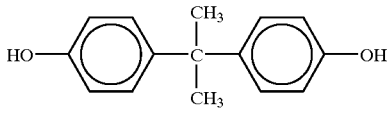

The third microcapsule layer section 66Y having the rockwork-like structure is produced by the following processes:

(1) 10 g of the bisphenol A powder and 10 g of the microcapsules 68Y are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The paper sheet 62 is coated with the suspension at about 3 g to 5 g per square meter, using a spray gun, and then the coated layer is allowed to naturally dry, resulting in production of the third microcapsule layer section 66Y having the rockwork-like structure as shown in FIGS. 11 and 12.

Note, as exaggeratedly shown in FIGS. 11 and 12, there remain fine clearances or pores in the rockwork-like structure of the third microcapsule layer section 66Y between the developer particles (bisphenol A powder) 70. Also note, since the microcapsules 68Y have a specific gravity greater than that of the developer particles 70, the microcapsules 68Y are submerged under the developer particles 70 in the rockwork-like structure.

If necessary, after the paper sheet 62 carrying the third microcapsule layer section 66Y is dried, it may be heated in an oven for about 15 minutes at a temperature of about 150° C. somewhat lower than the melting point (156° C.) of the bisphenol A powder (70) such that the developer particles 70 are fused to each other at their peripheral surfaces, thereby strengthening the rockwork-like structure of the third microcapsule layer section 66Y.

With the arrangement of the third microcapsule layer section 66Y, as long as the developer particles 70 exhibit a solid phase, i.e. as long as the third microcapsule layer section 66Y is not subjected to a temperature higher than the melting point (156° C.) of the bisphenol A powder, the microcapsules 68Y cannot be squashed and broken even though a pressure higher than 0.02 MPa, with the shearing force, is exerted on the third microcapsule layer section 66Y, because of the rockwork-like structure of the developer particles 70.

However, when the third microcapsule layer section 66Y is subjected to a temperature higher than the melting point (156° C.) of the bisphenol A powder, the developer particles 70 are thermally melted, resulting in the breakdown of the rockwork-like structure of the developer particles 70. Thus, when a breaking pressure higher than 0.02 MPa, with the shearing force, is exerted on the third microcapsule layer section 66Y, the microcapsules 68Y are directly subjected to the breaking pressure, resulting in breakage of the microcapsules 68Y.

Of course, when the microcapsules 68Y are broken, the oil ink, based on the yellow-producing leuco-dye or leuco-compound (I-3R), is discharged from the broken microcapsules, and yellow is developed due to the yellow-developing reaction of the discharge oil ink with the fused developer.

Figure 13:
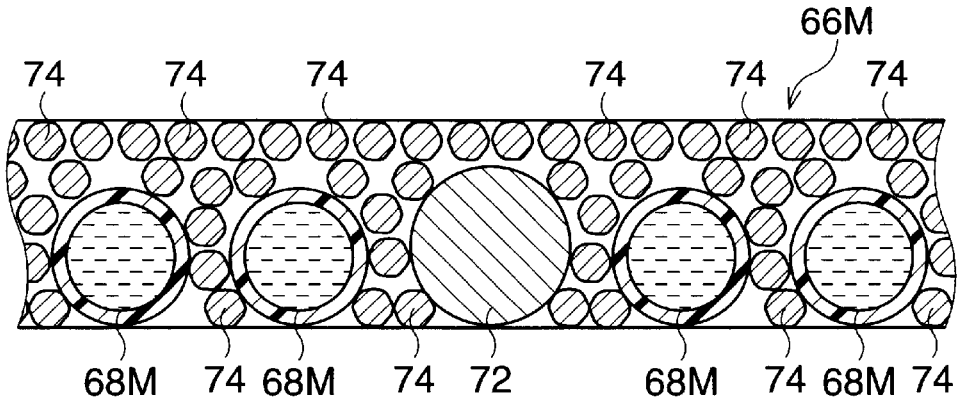
FIG. 13 is an enlarged schematic cross-sectional view of the second microcapsule layer section of the image-forming medium shown in FIG. 11.

As schematically shown in FIGS. 11 and 13, the second microcapsule layer section 66M also has a rockwork-like structure in which a plurality of microcapsules 68M, filled with a magenta ink or dye based on a magenta-producing leuco-dye or leuco-compound, and a plurality of spacer particles 72, are uniformly distributed in a rockwork-like arrangement of color developer particles 74.

Similar to the microcapsules 68Y, a shell wall of each microcapsule 68M is formed of a suitable amino resin, and the magenta dye contained in each microcapsule 68M is prepared as an oil dye composed of transparent oil containing about 6 wt. % of a magenta-producing leuco-dye or leuco-compound. For the transparent oil, KMC-113 is used, and for the magenta-producing leuco-dye or leuco-compound, Red-3, available from YAMAMOTO KASEI K.K., is used.

The microcapsules 68M can also be produced by the aforesaid polymerization method. The microcapsules 68M have an average diameter of about 6$\mu$ to 7$\mu$, and the shell wall of each microcapsule 68M has a thickness such that each microcapsule 68M is squashed and broken when being subjected to a pressure higher than about 0.2 MPa, with a shearing force. Also, the spacer particles 72 are formed of hydroxyapatite, and have an average diameter of about 8$\mu$ to 9$\mu$ larger than the average diameter of the microcapsules 68M.

For the developer particles 74, for example, benzyl p-hydroxybenzoate powder is used. The benzyl p-hydroxybenzoate powder has an average diameter of about 3$\mu$ to 5$\mu$, and is colored white.

Note, the benzyl p-hydroxybenzoate, which is a kind of p-hydroxybenzoic ester, exhibits a thermal melting point of about 110° C., and features the following structural formula:

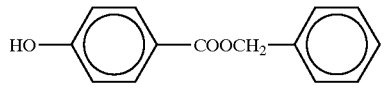

The second microcapsule layer section 66M having the rockwork-like structure is produced by the following processes:

(1) 10 g of the benzyl p-hydroxybenzoate powder, 10 g of the microcapsules 68M and 5 g of the spacer particles 72 are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The third microcapsule layer section 66Y, formed on the paper sheet 62, is coated with the suspension at about 2 g to 4 g at per square meter, using a spray gun, and then the coated layer is allowed to naturally dry, resulting in production of a second microcapsule layer section 66M having the rockwork-like structure as shown in FIGS. 11 and 13.

Note, as exaggeratedly shown in FIGS. 11 and 13, there remain fine clearances or pores in the rockwork-like structure of the second microcapsule layer section 66M between the developer particles (benzyl p-hydroxybenzoate powder) 74. Also note, since the microcapsules 68M and the spacer particles 72 have a specific gravity greater than that of the developer particles 74, the microcapsules 68M and the spacer particles 72 are submerged under the developer particles 74 in the rockwork-like structure.

Similar to the third microcapsule layer section 66Y, if necessary, after naturally drying the paper sheet 62 and third microcapsule layer section 66Y carrying the second microcapsule layer section 66M, it may be heated in the oven for about 15 minutes at a temperature of about 105° C. somewhat lower than the melting point (110° C.) of the benzyl p-hydroxybenzoate powder (74) such that the developer particles 74 are fused to each other at their peripheral surfaces, thereby strengthening the rockwork-like structure of the second microcapsule layer section 66M.

With the arrangement of the second microcapsule layer section 66M, as long as the developer particles 74 exhibit a solid phase, i.e. as long as the second microcapsule layer section 66M is not subjected to a temperature higher than the melting point (110° C.) of the benzyl p-hydroxybenzoate powder (74), the microcapsules 68M cannot be squashed and broken even though a pressure higher than 0.2 MPa, with the shearing force, is exerted on the second microcapsule layer section 66M, because the microcapsules 68M cannot be directly subjected to the breaking pressure due to the existence of the rockwork-like structure of the developer particles 74.

However, when the second microcapsule layer section 66M is subjected to a temperature higher than the melting point (110° C.) of the benzyl p-hydroxybenzoate powder, the developer particles 74 are thermally melted, resulting in the breakdown of the rockwork-like structure of the developer particles 74. Thus, when a breaking pressure higher than 0.2 MPa, with the shearing force, is exerted on the second microcapsule layer section 66M, the microcapsules 68M are directly subjected to the breaking pressure, resulting in breakage of the microcapsules 68M.

Of course, when the microcapsules 68M are broken, the oil ink, based on the magenta-producing leuco-dye or leuco-compound (Red-3), is discharged from the broken microcapsules, and magenta is developed due to the magenta-developing reaction of the discharge oil ink with the fused developer.

Figure 14:
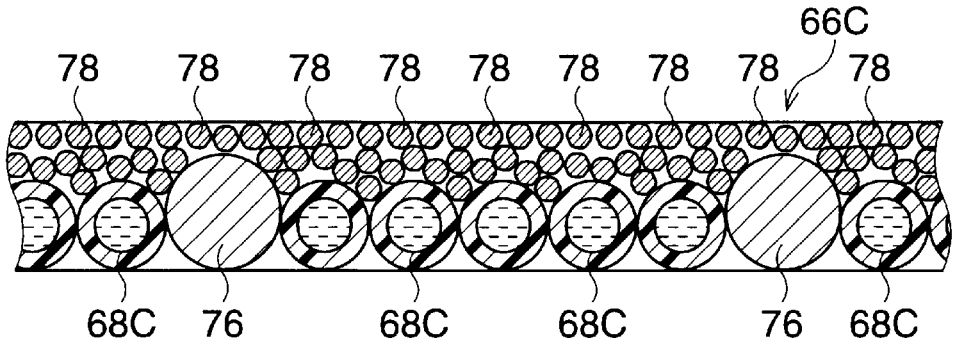
FIG. 14 is an enlarged schematic cross-sectional view of the first microcapsule layer section of the image-forming medium shown in FIG. 11.

As schematically shown in FIGS. 11 and 14, the first microcapsule layer section 66C also has a rockwork-like structure in which a plurality of microcapsules 68C, filled with a cyan ink or dye based on a cyan-producing leuco-dye or leuco-compound, and a plurality of spacer particles 76, are uniformly distributed in a rockwork-like arrangement of color developer particles 78.

Similar to the microcapsules 68Y and 68M, a shell wall of each microcapsule 68C is formed of a suitable amino resin, and the cyan dye contained in each microcapsule 68C is prepared as an oil dye composed of transparent oil containing about 6 wt. % of a cyan-producing leuco-dye or leuco-compound. For the oil, KMC-113 is used, and for the cyan-producing leuco-dye or leuco-compound, Blue200, available from YAMADA CHEMICAL K.K., is used.

The microcapsules 68C also can be produced by the aforesaid polymerization method. The microcapsules 68C have an average diameter of about 3$\mu$ to 4$\mu$, and the shell wall of each microcapsule 68C has a thickness such that each microcapsule 68C is squashed and broken when being subjected to a pressure of higher than about 2.0 MPa, with a shearing force. Also, the spacer particles 76 are formed of hydroxyapatite, and have an average diameter of about 5$\mu$ to 6$\mu$ larger than the average diameter of the microcapsules 68C.

For the developer particles 78, phenolic compound powder is used. The phenolic compound powder has an average diameter of about 1$\mu$ to 3$\mu$, and is colored white.

Note, the phenolic compound exhibits a thermal melting point of about 93° C., and features the following structural formula:

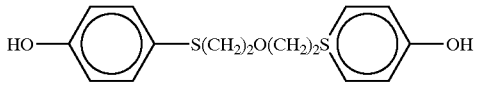

The first microcapsule layer section 66C having the rockwork-like structure is produced by the following processes:

(1) 10 g of the phenolic compound powder (78), 10 g of the microcapsules 68C and 5 g of the spacer particles 76 are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The microcapsule layer sections 66M and 66Y, formed on the paper sheet 62, is coated with the suspension at about 1 g to 3 g per square meter, using a spray gun, and then the paper sheet 62 and microcapsule layer sections 16M and 16Y carrying the coated layer is allowed to naturally dry, resulting in production of a first microcapsule layer section 66C having the rockwork-like structure as shown in FIGS. 11 and 14.

Note, as exaggeratedly shown in FIGS. 11 and 14, there remain fine clearances or pores in the rockwork-like structure of the first microcapsule layer section 66C between the developer particles (phenolic compound powder) 78. Also note, since the microcapsules 68C and the spacer particles 76 have a specific gravity larger than that of the developer particles 78, the microcapsules 68M and the spacer particles 76 are submerged under the developer particles 78 in the rockwork-like structure.

Similar to the third and second microcapsule layer sections 66Y and 66M, if necessary, after the drying of the paper sheet 62 and microcapsule layer sections 66Y and 66M carrying the first microcapsule layer section 66C is completed, it may be heated in the oven for about 15 minutes at a temperature of about 88° C. somewhat lower than the melting point (93° C.) of the phenolic compound powder (78) such that the developer particles 78 are fused to each other at their peripheral surfaces, thereby strengthening the rockwork-like structure of the first microcapsule layer section 66C.

With the arrangement of the first microcapsule layer section 66C, as long as the developer particles 78 exhibit a solid phase, i.e. as long as the first microcapsule layer section 66C is not subjected to a temperature higher than the melting point (93° C.) of the phenolic compound powder (78), the microcapsules 68C cannot be squashed and broken even though a pressure higher than 2.0 MPa, with the shearing force, is exerted on the first microcapsule layer section 66C, because the microcapsules 68C cannot be directly subjected to the pressure due to the existence of the rockwork-like structure of the developer particles 78.

However, when the first microcapsule layer section 66C is subjected to a temperature higher than the melting point (93° C.) of the phenolic compound powder, the developer particles 78 are thermally melted, resulting in the breakdown of the rockwork-like structure of the developer particles 78. Thus, when the breaking pressure higher than 2.0 MPa, with the shearing force, is exerted on the first microcapsule layer section 66C, the microcapsules 68C are directly subjected to the breaking pressure, resulting in breakage of the microcapsules 68C.

Of course, when the microcapsules 68C are broken, the oil ink, based on the cyan-producing leuco-dye or leuco-compound (Blue200), is discharged from the broken microcapsules, and cyan is developed due to the cyan-developing reaction of the discharge oil ink with the fused developer.

Figure 15:
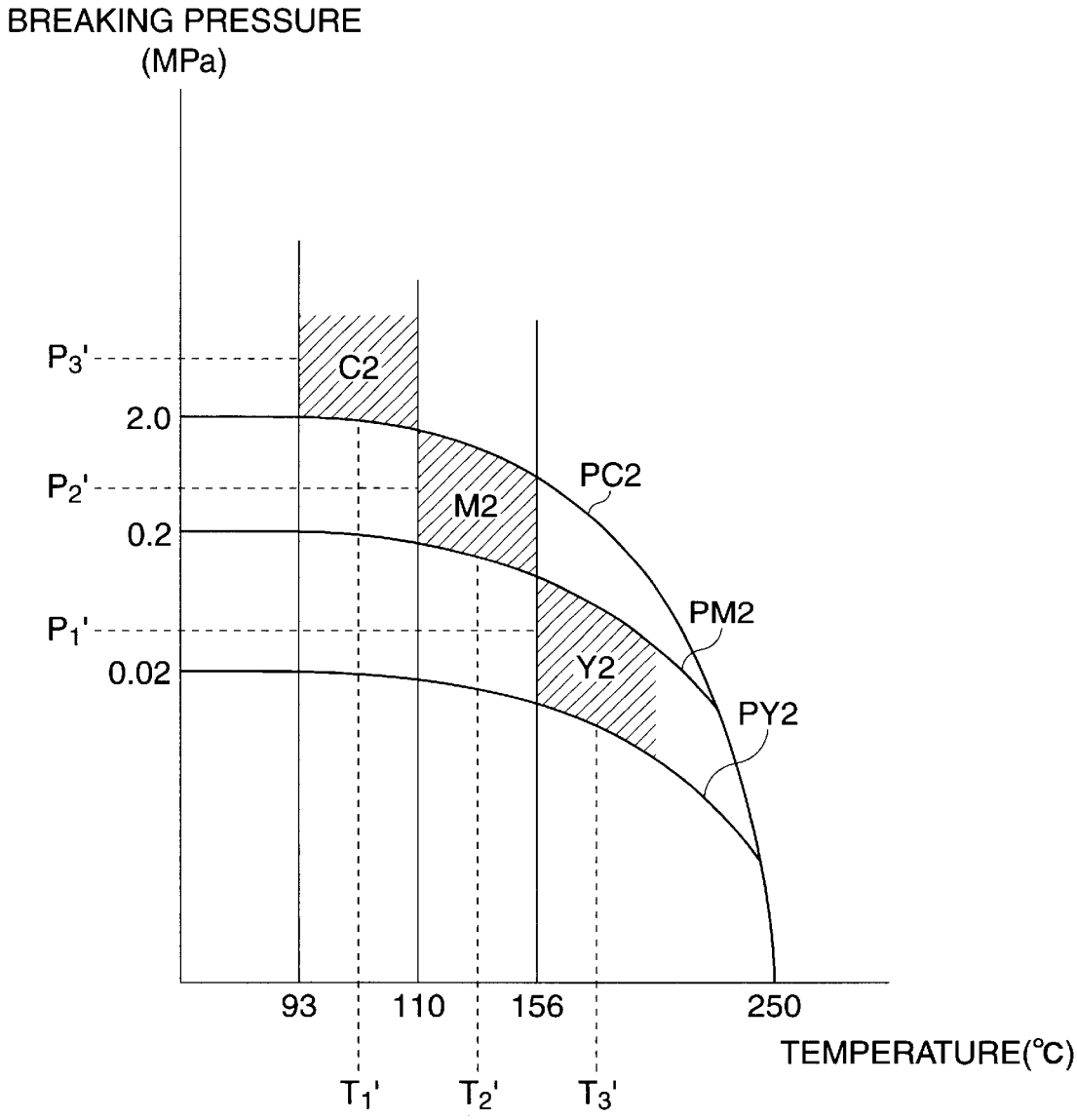
FIG. 15 is a graph showing three-primary color-developing areas defined on the second embodiment of the image-forming medium shown in FIG. 11.

Therefore, the respective microcapsules 68C, 68M and 68C, contained in the first, second and third microcapsule layer sections 16C, 16M and 16C of the microcapsule layer 64, are squashed and broken in accordance with temperature/pressure breaking characteristics as shown in a graph of FIG. 15.

In the graph of FIG. 15, reference PC2 represents a critical breaking-pressure curve of the cyan microcapsules 68C. As stated above, although the cyan microcapsules 68C are squashed and broken under room temperature when being directly subjected to higher than the critical breaking pressure 2.0 MPa, with the shearing force, the critical breaking pressure decreases in accordance with the rise in temperature as represented by the critical breaking-pressure curve PC2.

Also, in the graph of FIG. 15, reference PM2 represents a critical breaking-pressure curve of the magenta microcapsules 68M. Although the magenta microcapsules 68M are squashed and broken under room temperature when being directly subjected to higher than the critical breaking pressure 0.2 MPa, with the shearing force, the critical breaking pressure decreases in accordance with the rise in temperature as represented by the critical breaking-pressure curve PM2.

Further, in the graph of FIG. 15, reference PY2 represents a critical breaking-pressure curve of the yellow microcapsules 68Y. Although the yellow microcapsules 68Y are squashed and broken under room temperature when being directly subjected to higher than the critical breaking pressure 0.02 MPa, with the shearing force, the critical breaking pressure decreases in accordance with the rise in temperature as represented by the critical breaking-pressure curve PY2.

In FIG. 15, the temperature/pressure range for squashing and breaking the cyan microcapsules 68C is represented as a hatched cyan-developing area C2, defined by the critical breaking-pressure curve PC2, the melting point (93° C.) of the phenolic compound powder (78) and the melting point (110° C.) of the benzyl p-hydroxybenzoate powder (74). Also, the temperature/pressure range for squashing and breaking the magenta microcapsules 68M is shown as a hatched magenta-developing area M2, defined by the critical breaking-pressure curve PM2, the melting point (110° C.) of the benzyl p-hydroxybenzoate powder (74) and the melting point (156° C.) of the bisphenol A powder (70). Further, the temperature/pressure range for squashing and breaking the yellow microcapsules 68Y is shown as a hatched yellow-developing area Y2, defined by the critical breaking-pressure curve PY2 and the melting point (150° C.) of the bisphenol A powder (70).

Thus, by suitably selecting a heating temperature and a breaking pressure to be locally exerted on the microcapsule layer 64 of the image-forming medium 60, it is possible to selectively squash and break the cyan, magenta and yellow microcapsules 68C, 68M and 68Y at the localized area of the image-forming medium 60 on which the heating temperature and the breaking pressure are exerted.

For example, as shown in FIG. 15, if a heating temperature $T_1'$ and a breaking pressure $P_3'$, to be locally exerted on the image-forming medium 60, are selected so as to fall within the hatched cyan-developing area C2, only the cyan microcapsules 68C are squashed and broken at the localized area of the image-forming medium 60 on which the heating temperature $T_1'$ and the breaking pressure $P_3'$ are exerted, resulting in discharge of the cyan dye (cyan-producing leuco-dye or leuco-compound) from the broken microcapsules 68C.

Also, as shown in FIG. 15, if a heating temperature $T_2'$ and a breaking pressure $P_2'$, to be locally exerted on the image-forming medium 60, are selected so as to fall within the hatched magenta-developing area M2, only the magenta microcapsules 68M are squashed and broken at the localized area of the image-forming medium 60 on which the heating temperature $T_2'$ and the breaking pressure $P_2'$ are exerted, resulting in discharge of the magenta dye (magenta-producing leuco-dye or leuco-compound) from the broken microcapsules 68M.

Further, as shown in FIG. 15, if a heating temperature $T_3'$ and a breaking pressure $P_1'$, to be locally exerted on the image-forming medium 60, are selected so as to fall within the hatched yellow-developing area Y2, only the yellow microcapsules 68Y are squashed and broken at the localized area of the image-forming medium 60 on which the heating temperature $T_3'$ and the breaking pressure $P_1'$ are exerted, resulting in discharge of the yellow dye (yellow-producing leuco-dye or leuco-compound) from the broken microcapsules 68Y.

Note, in this embodiment, the heating temperatures $T_1'$, $T_2'$ and $T_3'$ may be set as 100° C., 130° C. and 170° C., respectively, and the breaking pressures $P_1'$, $P_2'$ and $P_3'$ may be set as 0.05 MPa, 0.5 MPa and 3.0 MPa, respectively.

A full color image can be formed on the image-forming medium 60, using the printer as shown in FIGS. 6 and 7, provided that it is modified as follows:

(1) Each of the electric resistance elements $R_{c1}$ to $R_{cn}$ is heated to the temperature $T_1'$ (100° C.) when being energized;

(2) The second spring-biasing unit 44M is set such that the second roller platen 42M is elastically pressed against the third thermal head 40Y at the pressure $P_2'$ (0.5 MPa); and (3) The third spring-biasing unit 44Y is set such that the third roller platen 42Y is elastically pressed against the third thermal head 40Y at the pressure $P_1'$ (0.05 MPa).

Note, the respective temperatures $T_2$ and $T_3$ set in the first embodiment are equal to the temperatures $T_2'$ and $T_3'$, and the pressure $P_3$ set in the first embodiment is equal to the pressure $P_3'$.

Similar to the image-forming medium 10 according to the first embodiment, during a printing operation, the image-forming medium 60 is introduced into the entrance opening 32 such that the microcapsule layer 64 thereof is in direct contact with the thermal heads 40C, 40M and 40Y.

While the image-forming medium 60 passes between the first thermal head 40C and the first roller platen 42C without all the electric resistance elements $R_{c1}$ to $R_{cn}$ being energized, the microcapsule layer 64 of the image-forming medium 60 is subjected to the breaking-pressure $P_3'$ (3.0 MPa), with the shearing force, from each electric resistance element ($R_{c1}$, . . . , $R_{cn}$) of the first thermal head 40C. Nevertheless, the breaking-pressure $P_3'$, with the shearing force, cannot be exerted on the cyan microcapsules 68C due to the existence of the rockwork-like structure of the first microcapsule layer section 66C.

Figure 18:
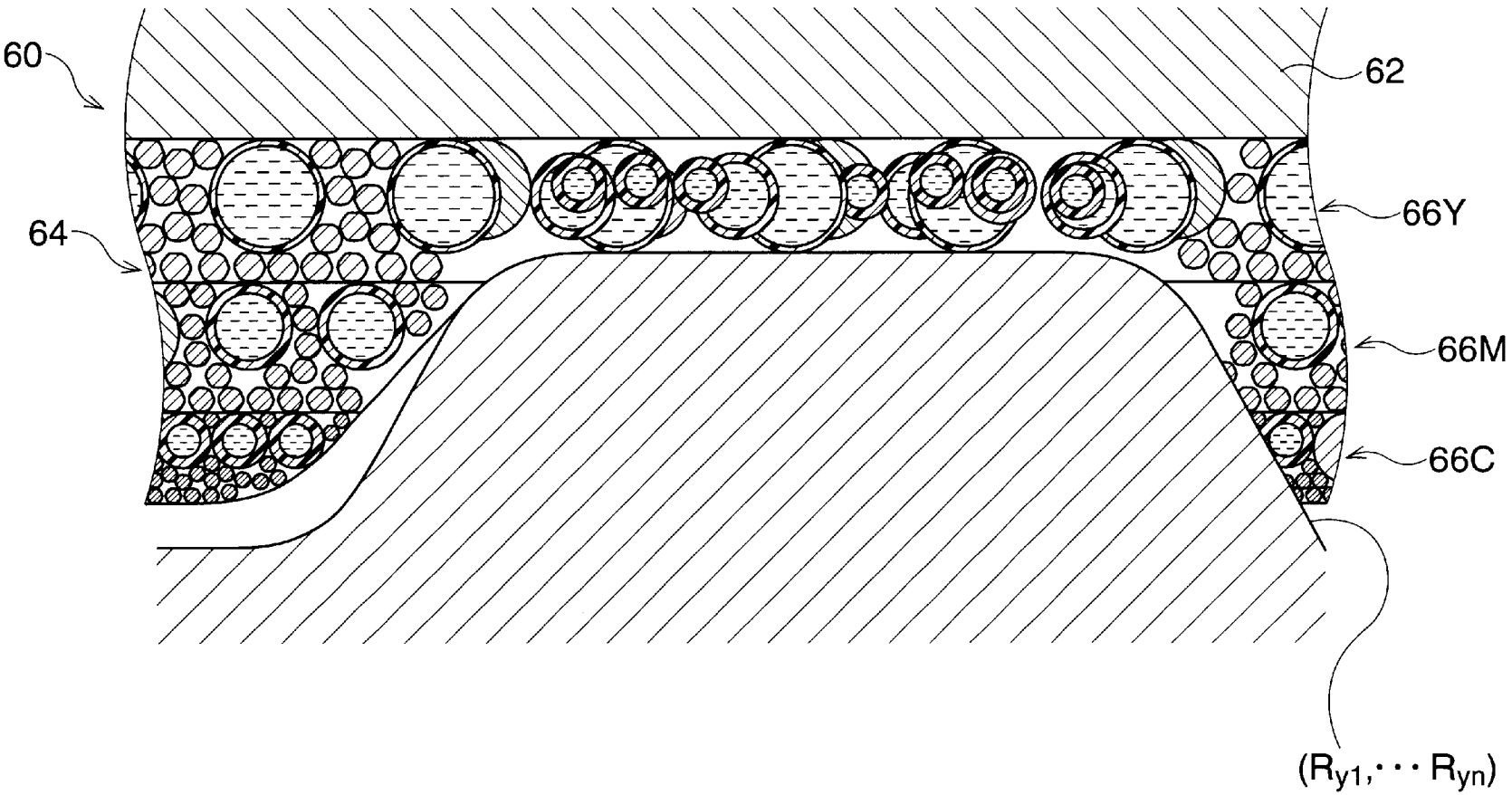
FIG. 18 is a schematic cross-sectional view showing penetration of an electric resistance element of the third thermal head in the first, second and third microcapsule layer sections to thereby develop a yellow dot on the image-forming medium shown in FIG. 11.

However, when any one of the electric resistance elements $R_{c1}$ to $R_{cn}$ is electrically energized to be heated to the temperature $T_1'$ (100° C.) higher than the melting point (93° C.) of the phenolic compound powder (78), the heated electric resistance element ($R_{c1}$, . . . , $R_{cn}$) penetrates into the first microcapsule layer section 66C, as shown in FIG. 18 by way of example, because a portion of the rockwork-like structure of the first microcapsule layer section 66C, to which the heated element ($R_{c1}$, . . . , $R_{cn}$) is applied, is thermally melted and collapsed. Thus, the cyan microcapsules 68C, included in the collapsed portion of the rockwork-like structure, are directly subjected to the breaking-pressure $P_3'$ (3.0 MPa), with the shearing force, from the heated element ($R_{c1}$, . . . , $R_{cn}$), and thus are squashed and broken, resulting in discharge of the cyan dye from the broken microcapsules 68C. The discharged cyan dye, based on the cyan-producing leuco-dye or leuco-compound (Blue200), reacts with the molten color developer (phenolic compound), thereby producing a cyan dot on the microcapsule layer 64 of the image-forming medium 60 by the heated element ($R_{c1}$, . . . , $R_{cn}$).

Figure 16:
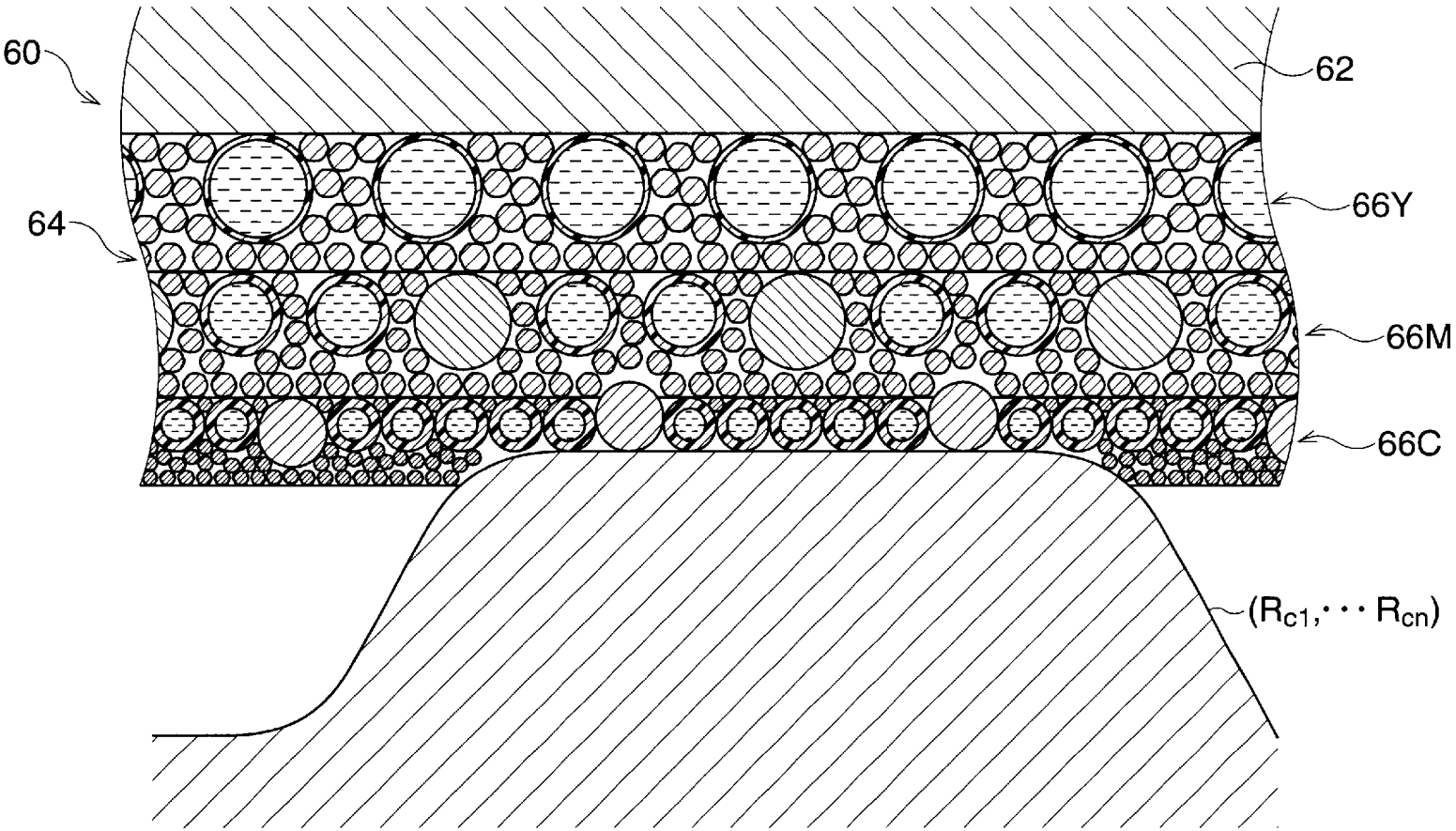
FIG. 16 is a schematic cross-sectional view showing a penetration of an electric resistance element of the first thermal head in the first microcapsule layer section to thereby develop a cyan dot on the image-forming medium shown in FIG. 11.

Note, in FIG. 16, although the molten color developer is not shown to avoid complication of illustration, it is absorbed into the fine clearances or pores of the rockwork-like structures of the first and second microcapsule layer sections 66C and 66M.

While the image-forming medium 60 passes between the second thermal head 40M and the second roller platen 42M without all the electric resistance elements $R_{m1}$ to $R_{mn}$ being energized, the microcapsule layer 64 of the image-forming medium 60 is subjected to the breaking-pressure $P_2'$ (0.5 MPa), with the shearing force, from each electric resistance element ($R_{m1}$, . . . , $R_{mn}$) of the second thermal head 40M. Nevertheless, the breaking-pressure $P_2'$, with the shearing force, cannot be exerted on the magenta microcapsules 68M due to the existence of the rockwork-like structures of the first and second microcapsule layer sections 66C and 66M.

Figure 17:
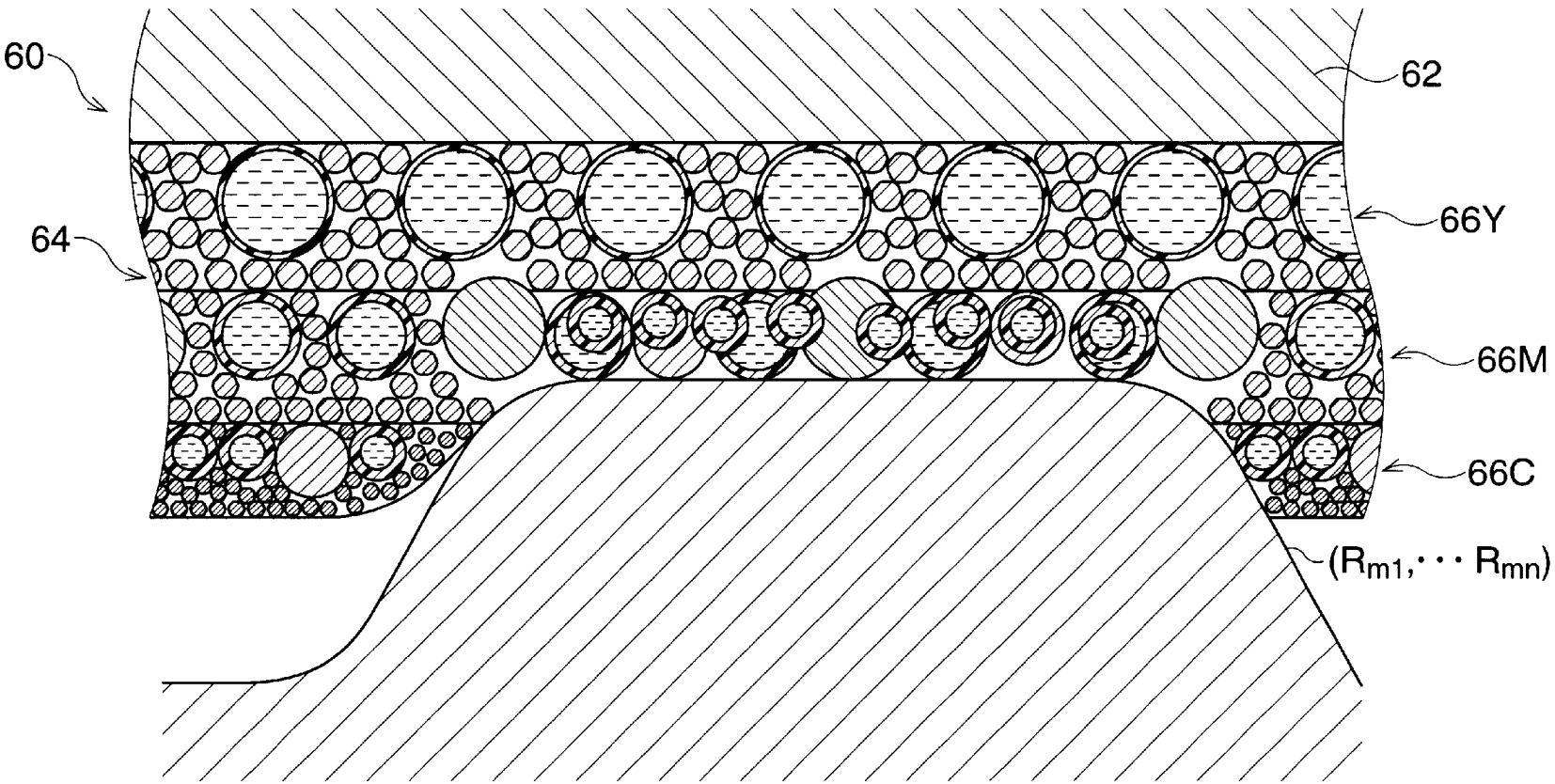
FIG. 17 is a schematic cross-sectional view showing penetration of an electric resistance element of the second thermal head in the first and second microcapsule layer sections to thereby develop a magenta dot on the image-forming medium shown in FIG. 11.

However, when any one of the electric resistance elements $R_{m1}$ to $R_{mn}$ is electrically energized to be heated to the temperature $T_2'$ (130° C.) higher than the melting point (93° C.) of the phenolic compound powder (78) and the melting point (110° C.) of the benzyl p-hydroxybenzoate powder (74), the heated electric resistance element ($R_{m1}$, . . . , $R_{mn}$) penetrates into the first and second microcapsule layer sections 66C and 66M, as shown in FIG. 17, because a portion of the rockwork-like structures of the first and second microcapsule layer sections 66C and 66M, to which the heated element ($R_{m1}$, . . . , $R_{mn}$) is applied, is thermally melted and collapsed. Thus, the cyan and magenta microcapsules 68C and 68M, included in the collapsed portion of the rockwork-like structures, are directly subjected to the breaking-pressure $P_2'$ (0.5 MPa), with the shearing force, from the heated element ($R_{m1}$, . . . , $R_{mn}$).

At this time, the cyan microcapsules 68C can endure the breaking-pressure $P_2'$, with the shearing force, but the magenta microcapsules 68M cannot endure the breaking-pressure $P_2'$ with the shearing force. Thus, only the magenta microcapsules 68M are squashed and broken, resulting in discharge of the magenta dye from the broken microcapsules 68M. The magenta dye, based on the magenta-producing leuco-dye or leuco-compound (Red-3), reacts with the molten color developer (phenolic compound and benzyl p-hydroxybenzoate), thereby producing a magenta dot on the microcapsule layer 64 of the image-forming medium 60 by the heated element ($R_{m1}$, . . . , $R_{mn}$).

Note, in FIG. 17, although the molten color developers (phenolic compound and benzyl p-hydroxybenzoate) are not shown to avoid complication of illustration, they are absorbed into the fine clearances or pores of the rockwork-like structures of the first and second microcapsule layer sections 66C and 66M.

While the image-forming medium 60 passes between the third thermal head 40Y and the third roller platen 42Y without all the electric resistance elements $R_{y1}$ to $R_{yn}$ being energized, the microcapsule layer 64 of the image-forming medium 60 is subjected to the breaking-pressure $P_1'$ (0.05 MPa) with the shearing force from each electric resistance element ($R_{y1}$, . . . , $R_{yn}$) of the third thermal head 40Y. Nevertheless, the breaking-pressure $P_1'$, with the shearing force, cannot be exerted on the yellow microcapsules 68Y due to the existence of the rockwork-like structures of the first, second and third microcapsule layer sections 66C, 66M and 66Y.

However, when any one of the electric resistance elements $R_{y1}$ to $R_{yn}$ is electrically energized to be heated to the temperature $T_1'$ (170° C.) higher than the melting point (93° C.) of the phenolic compound powder (78), the melting point (110° C.) of the benzyl p-hydroxybenzoate powder (74) and the melting point (156° C.) of the bisphenol A powder (70), the heated electric resistance element ($R_{y1}$, . . . , $R_{yn}$) penetrates into the first, second and third microcapsule layer sections 66C, 66M and 66Y, as shown in FIG. 18, because a portion of the rockwork-like structures of the first, second and third microcapsule layer sections 66C, 66M and 66Y, to which the heated element ($R_{y1}$, . . . , $R_{yn}$) is applied, is thermally melted and collapsed. Thus, the cyan, magenta and yellow microcapsules 68C, 68M and 68Y, included in the collapsed portion of the rockwork-like structures, are directly subjected to the breaking-pressure $P_1'$ (0.05 MPa), with the shearing force, from the heated element ($R_{y1}$, . . . , $R_{yn}$).

At this time, the cyan and magenta microcapsules 68C and 68M can endure the breaking-pressure $P_1'$ with the shearing force, but the yellow microcapsules 68Y cannot endure the breaking-pressure $P_1'$ with the shearing force. Thus, only the yellow microcapsules 68Y are squashed and broken, resulting in discharge of the yellow dye from the broken microcapsules 18Y. The discharged yellow dye, based on the yellow-producing leuco-dye or leuco-compound (I-3R), reacts with the molten color developer (phenolic compound, benzyl p-hydroxybenzoate and bisphenol A), thereby producing a yellow dot on the microcapsule layer 64 of the image-forming medium 60 by the heated element ($R_{y1}$, . . . , $R_{yn}$).

Note, in FIG. 18, although the molten color developers are not shown to avoid complication of illustration, they are absorbed into the fine clearances or pores of the rockwork-like structures of the first, second and third microcapsule layer sections 66C, 66M and 66Y and in fine clearances or pores of the paper sheet 62.

The respective spacer particles 76 and 72, included the first and second microcapsule layer section 66C and 66M, have the same function as the spacer particles 26 and 22, included the first microcapsule layer section 16C and 16M of the aforesaid image-forming medium 60. Namely, large-sized cyan microcapsules (68C), which may be included in the first microcapsule layer section 66C, can be prevented from being concentrically subjected to the breaking-pressure $P_2'$ with the shearing force, due to the existence of the spacer particles 76, and thus the large-sized cyan microcapsules cannot be uncontrollably and undesirably squashed and broken. Similarly, large-sized magenta microcapsules (68M), which may be included in the second microcapsule layer section 66M, can be prevented from being concentrically subjected to the breaking-pressure $P_1'$ with the shearing force, due to the existence of the spacer particles 72, and thus the large-sized magenta microcapsules cannot be uncontrollably and undesirably squashed and broken.

It should be understood that the image-forming medium 60 exhibits an inherent advantage in that the microcapsule layer 64 is not susceptible to noise. In particular, for example, if a microcapsule (68Y, 68M, 68Y) included in the microcapsule layer 64 is accidentally and mechanically broken, resulting in discharge of a leuco-compound-based dye from the broken microcapsule, the discharged leuco-compound-based dye cannot react with a color developer dye until it is heated to a color-developing temperature. This feature is especially significant when the image-forming medium 60 is cut by a pair of scissors or a cutter knife. Namely, although the leuco-compound-based dyes may be discharged along the cut faces of the image-forming medium 60, the discharged leuco-compound-based dyes cannot react with the color developers, thereby preventing a color-development along the cut faces of the image-forming medium 60.

In the second embodiment, although blue200 is utilized for the cyan-producing cyan-pigment, benzoyl leucomethylene blue (BLMB) may be substituted for blue200. Also, R-500, available from YAMADA CHEMICAL K.K., may be substituted for the magenta-producing leuco-dye or leuco-compound (Red-3), and F color Yellow 17, available from YAMAMOTO KASEI K.K., may be substituted for the yellow-producing leuco-dye or leuco-compound (I-3R).

In the second embodiment, although the transparent oil (KMC-113) is utilized as a vehicle for each leuco-dye or leuco-compound, another transparent oil, such as second-grade butyl biphenyl, phenyl xylyl ethane, di-isopropyl phenyl, xylene-based oil or the like, may be substituted for KMC-113.

In the second embodiment, in order to facilitate a color-developing reaction of each leuco-compound-based dye, a suitable small amount of p-venzyl diphenyl may be added as a sensitizer to each of the microcapsule layer sections 66C, 66M and 66Y.

The sensitizer (p-venzyl diphenyl) exhibits a thermal melting point of about 86° C., and it is possible to regulate a thermal melting point of each color developer by adding a suitable amount of the sensitizer to the color developer. For example, the melting point (156° C.) of the bisphenol A powder (isopropylidenebisphenol) can be lowered to either 110° C. or 93° C. by adding a given amount of p-venzyl diphenyl to the bisphenol A powder. Thus, the bisphenol A powder exhibiting the melting point 110° C. may be substituted for the benzyl p-hydroxybenzoate powder (melting point 110° C.) of the second microcapsule layer 66M, and the bisphenol A powder exhibiting the melting point 93° C. may be substituted for the phenolic compound powder (melting point 93° C.) of the first microcapsule layer 66C.

Note, it should be understood that the various changes and modifications, stated with respect to the first embodiment (FIG. 1), may be suitably made to the second embodiment (FIG. 11), if necessary.

Figure 19:
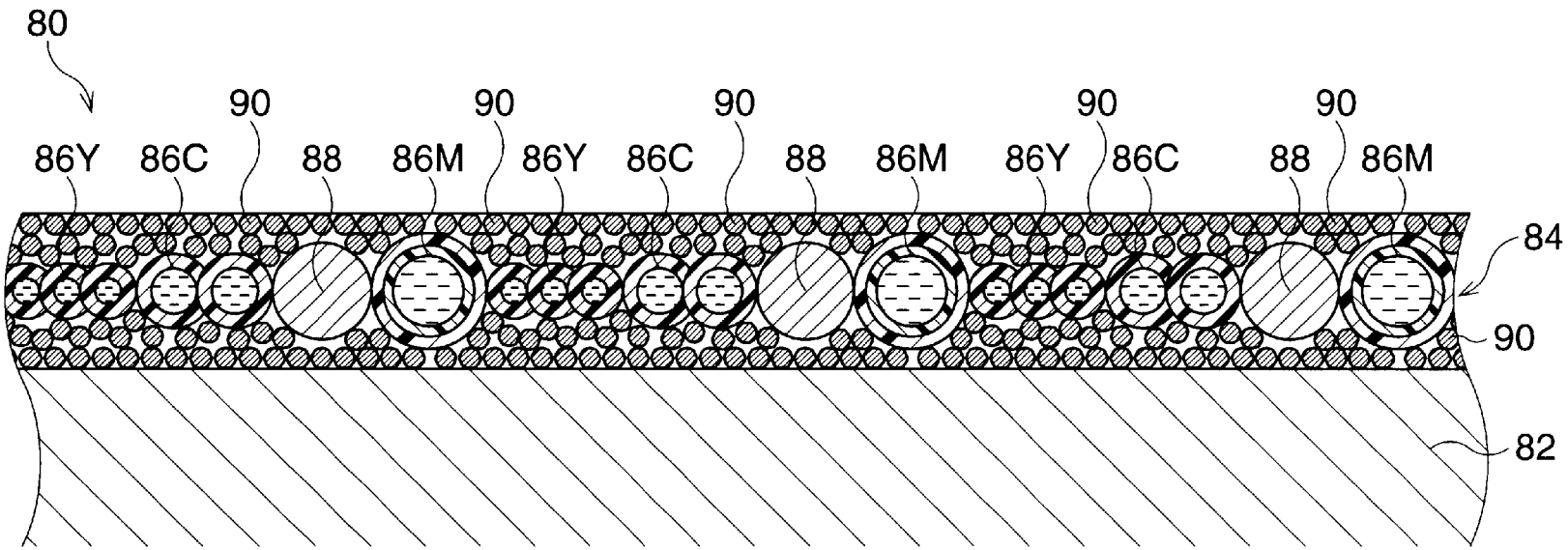
FIG. 19 is a schematic conceptual cross-sectional view showing a third embodiment of the image-forming medium, according to the present invention, coated with a single layer of cyan, magenta and yellow microcapsules for forming a full color image thereon.

FIG. 19 schematically shows a third embodiment of an image-forming medium, generally indicated by reference numeral 80, according to the present invention. The image-forming medium 80 also comprises a sheet-like substrate, such as a sheet of paper 82, and a single layer of microcapsule 84 formed thereon. In this embodiment, the single microcapsule layer 84 has a rockwork-like structure, in which a plurality of cyan microcapsules 86C, filled with a cyan ink or dye based on a cyan-producing leuco-dye or leuco-compound, a plurality of magenta microcapsules 86M, filled with a magenta ink or dye based on a magenta-producing leuco-dye or leuco-compound, a plurality of yellow microcapsules 86M, filled with a cyan ink or dye based on a yellow-producing leuco-dye or leuco-compound, and a plurality of spacer particles 68 are uniformly distributed in a rockwork-like arrangement of color developer particles 90.

Each cyan microcapsule 86C is substantially identical to the cyan microcapsule 68C used in the second embodiment (FIG. 11). Namely, a shell wall of each cyan microcapsule 86C is formed of a suitable amino resin, and the cyan dye contained in each cyan microcapsule 86C is prepared as an oil dye composed of the transparent oil (KMC-113) containing about 6 wt. % of the cyan-producing leuco-dye or leuco-compound (Blue200). Also, the cyan microcapsules 86C have an average diameter of about 3$\mu$ to 4$\mu$, and the shell wall of each cyan microcapsule 86C has a thickness such that each microcapsule 86C is squashed and broken when being subjected to a pressure of higher than about 2.0 MPa, with a shearing force.

Figure 20:
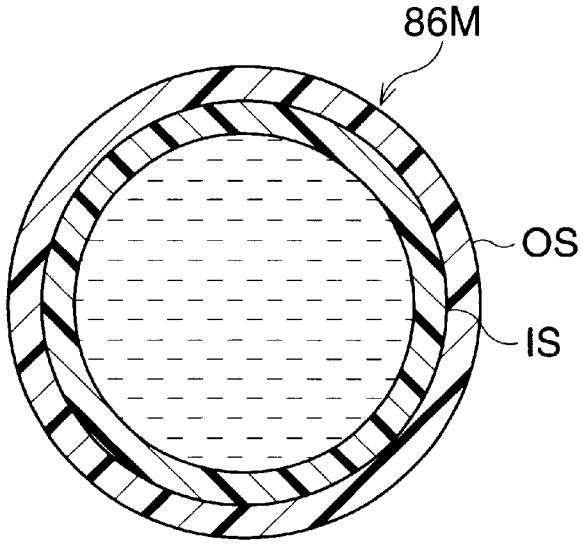
FIG. 20 is a schematic conceptual cross-sectional view representing one of the magenta microcapsules with an wax-type outer shell wall, used in the image-forming medium shown in FIG. 19.
Figure 21:
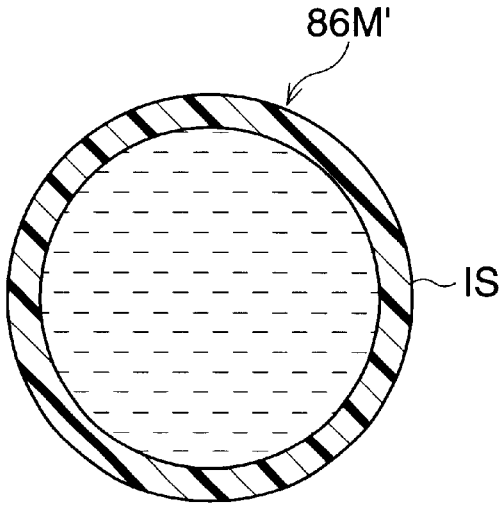
FIG. 21 is a cross-sectional view showing a magenta microcapsule (FIG. 20) from which the wax-type outer shell wall is removed.

As shown in FIG. 20, each magenta microcapsule 86M has a double-shell-wall structure composed of an inner shell wall section IS and an outer shell wall section OS. The inner shell wall section IS is formed of a suitable amino resin, and the outer shell wall section OS is formed a suitable wax material, for example, olefin wax exhibiting a thermal melting point of about 121° C. and colored white, which is available as HIWAX 405MP from MITSUI PETROLEUM CHEMICAL. Thus, when the magenta microcapsule 86M is heated to a temperature higher than the melting point (121° C.) of olefin wax, the outer shell wall OS is thermally melted so that the magenta microcapsule 86M is changed to a naked magenta microcapsule 86M', as shown in FIG. 21.

The naked magenta microcapsule 86M' is substantially identical to the magenta microcapsule 68M used in the second embodiment (FIG. 11). Namely, the magenta dye contained in each magenta microcapsule 86M is prepared as an oil dye composed of the transparent oil (KMC-113) containing about 6 wt. % of the magenta-producing leuco-dye or leuco-compound (Red-3). Also, the naked microcapsules 86M' have an average diameter of about 6$\mu$ to 7$\mu$, and the inner shell wall section IS has a thickness such that the naked magenta microcapsule 86M' is squashed and broken when being subjected to a pressure of higher than about 0.2 MPa, with a shearing force.

In short, it is possible to obtain the magenta microcapsule 86M by coating the magenta microcapsule 68M (FIG. 11) with the olefin wax (HIWAX 405MP), using either a spray dry method or a phase-separation method. Note, although the naked microcapsule 86M' is squashed and broken when being subjected to the pressure higher than the critical breaking-pressure (0.2 MPa), with the shearing force, the microcapsule 86M having the coated outer shell section OS can endure a pressure far higher than the pressure 2.0 MPa under room temperature.

shell wall of each yellow microcapsule 86Y is formed of a suitable amino resin, and the yellow dye contained in each yellow microcapsule 86Y is prepared as an oil dye composed of a mixed transparent oil containing about 6 wt. % of the yellow-producing leuco-dye or leuco-compound (I-3R). The yellow microcapsules 86Y may be produced by the aforesaid polymerization method, and have an average diameter of about 1$\mu$ to 3$\mu$.

The mixed transparent oil is composed of 70% of KMC-113, exhibiting the boiling point of about 300° C., and 30% of a low-boiling silicone oil, which is available as KF96L-065 from SHINETSU SILICONE K.K., thereby exhibiting a primary axeotropic point of about 150° C. The shell wall of each microcapsule 86Y has a thickness such that the microcapsule 86Y can endure a pressure higher than 2.0 MPa under a temperature lower than the primary axeotropic point 150° C., but the microcapsule 86Y ruptures when being heated to a temperature higher than the primary axeotropic point 150° C., due to an abrupt increase in an internal pressure of the heated microcapsule 86Y.

Note, the low-boiling silicone oil (KF96L-065) may be replaced by xylene, n-heptane, benzene, naphthalene or the like.

The spacer particles 88 are substantially identical to the spacer particles 76 used in the first microcapsule layer section 66C of the second embodiment (FIG. 11). Namely, the spacer particles 88 are formed of hydroxyapatite, and have an average diameter of about 5$\mu$ to 6$\mu$ larger than the average diameter of the microcapsules 86C. The function of the spacer particles 88 is substantially the same as the spacer particles 76 used in the first microcapsule layer section 66C of the second embodiment (FIG. 11).

The developer particles 90 are substantially identical to the developer particles 78 used in the first microcapsule layer section 66C of the second embodiment (FIG. 11). Namely, for the developer particles 90, the phenolic compound powder exhibiting a thermal melting point of about 93° C. and having an average diameter of about 1$\mu$ to 3$\mu$, is used.

The single microcapsule layer 84 having the rockwork-like structure is produced by the following processes:

(1) 10 g of the phenolic compound powder (90), 2.5 g of the cyan microcapsules 86C, 2.5 g of the magenta microcapsules 86M, 3.0 g of the yellow microcapsules 86Y and 2.5 g of the spacer particles 88 are mixed with 100 g of 3 wt. % aqueous solution of polyvinyl alcohol (PVA) exhibiting a polymerization degree of 2000 and containing a small quantity of dispersant (such as dodecyl benzenesulfonic sodium or the like), and the mixture is agitated to prepare a suspension.

(2) The paper sheet 82 is coated with the suspension at about 8 g to 9 g per square meter, using a spray gun, and then the paper sheet 82 carrying the coated layer is allowed to naturally dry, resulting in production of a single microcapsule layer 84 having the rockwork-like structure as shown in FIG. 19.

Note, as exaggeratedly shown in FIG. 19, there remain fine clearances or pores in the rockwork-like structure of the single microcapsule layer 84 between the developer particles (phenolic compound powder) 90.

If necessary, after the paper sheet 82 carrying the single microcapsule layer 84 is dried, it may be heated in the oven for about 15 minutes at a temperature of about 88° C. somewhat lower than the melting point (93° C.) of the phenolic compound powder (90) such that the developer particles 90 are fused to each other at their peripheral surfaces, thereby strengthening the rockwork-like structure of the single microcapsule layer 84.

With the arrangement of the single microcapsule layer 84, as long as the developer particles 90 exhibit a solid phase, i.e. as long as the single microcapsule layer 84 is not subjected to a temperature higher than the melting point (93° C.) of the phenolic compound powder (90), even though a breaking pressure of higher than 2.0 MPa, with a shearing force, is exerted on the single microcapsule layer 84, the cyan, magenta and yellow microcapsules 86C, 86M and 86Y cannot be directly subjected to the breaking pressure due to the existence of the rockwork-like structure of the developer particles 90.

However, when the single microcapsule layer 84 is subjected to a temperature higher than the melting point (93° C.) of the phenolic compound powder (90), the developer particles 90 are thermally melted, resulting in the breakdown of the rockwork-like structure of the developer particles 90. At this time, if the heating temperature is lower than the melting point (121° C.) of the outer shell wall section OS of the magenta microcapsules 86M, and if a breaking pressure higher than 2.0 MPa, with the shearing force, is exerted on the single microcapsule layer 84, only the cyan microcapsules 68C are squashed and broken, because the magenta and yellow microcapsules 86M and 86Y can endure the breaking pressure of higher than 2.0 MPa when the temperature is lower than the melting point (121° C.) of the outer shell wall section OS of the magenta microcapsules 86M.

Also, if the heating temperature is lower than the primary azeotropic point (150° C.) of the mixed oil (yellow dye) contained in the yellow microcapsule 86Y, and if a breaking pressure lower than 2.0 MPa, with the shearing force, is exerted on the single microcapsule layer 84, only the magenta microcapsules 68M are squashed and broken, because the cyan and yellow microcapsules 86C and 86Y can endure a breaking pressure lower than 2.0 MPa when the temperature is lower than the primary azeotropic point 150° C. of the mixed oil (yellow dye) contained in the yellow microcapsule 86Y.

Further, if the heating temperature is higher than the primary azeotropic point (150° C.) of the mixed oil (yellow dye) contained in the yellow microcapsule 86Y, and if a breaking pressure lower than 0.2 MPa, with the shearing force, is exerted on the single microcapsule layer 84, only the yellow microcapsules 68Y rupture, due to the abrupt increase in an internal pressure of the heated microcapsules 86Y. Note, the cyan and magenta microcapsules 86C and 86M can endure a breaking pressure lower than 0.2 MPa when the temperature is higher than the primary azeotropic point (150° C.) of the mixed oil contained in the yellow microcapsule 86Y.

Figure 22:
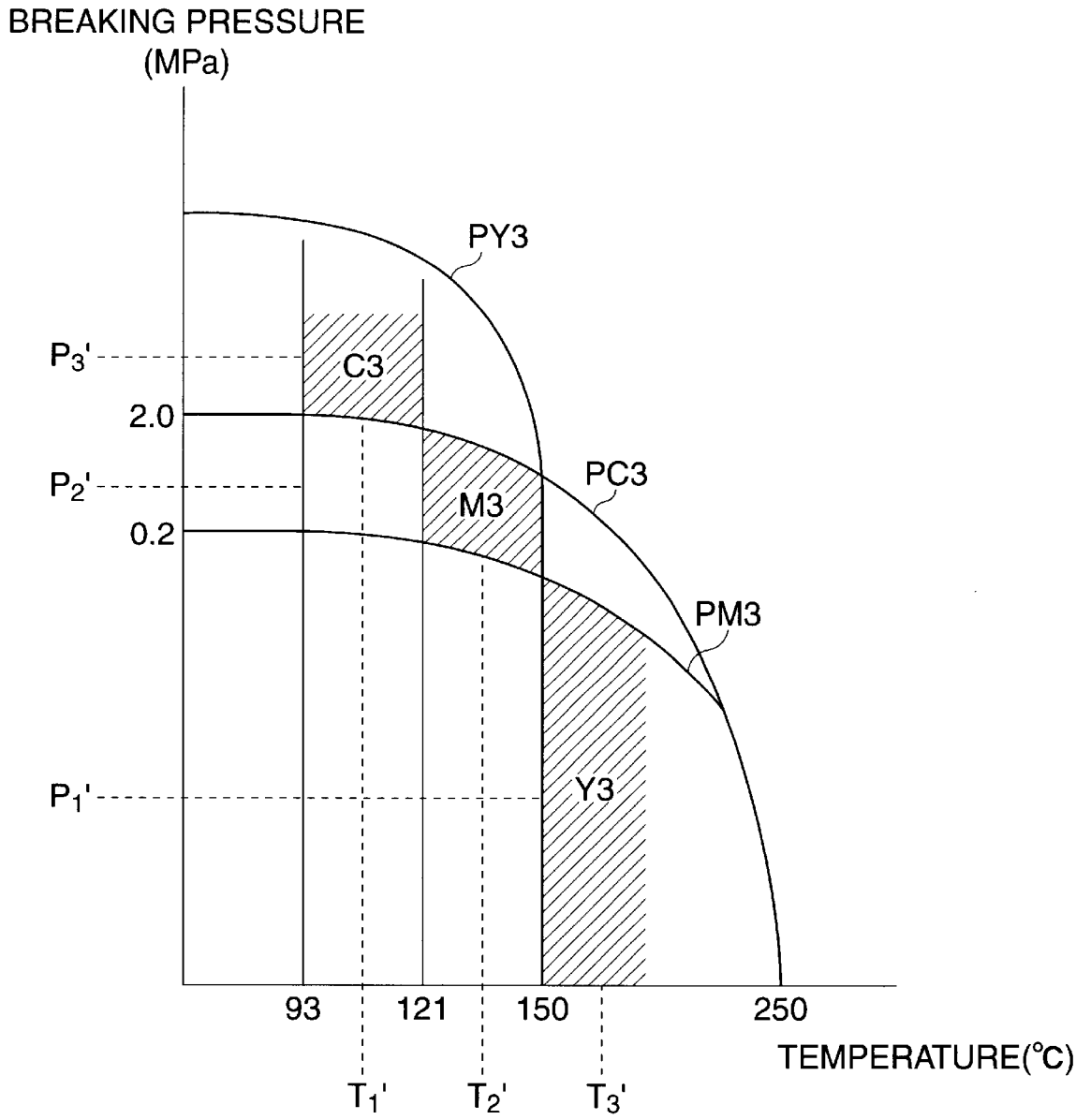
FIG. 22 is a graph showing three-primary color-developing areas defined on the third embodiment of the image-forming medium shown in FIG. 19.

Therefore, as shown in a graph of FIG. 22, a hatched cyan-developing area C3, a hatched magenta-developing area M3 and a hatched yellow-developing area Y3 are defined with respect to the single microcapsule layer 84 of the image-forming medium 80.

In particular, the cyan-developing area C3 is defined by a critical breaking-pressure curve PC3 of the cyan microcapsules 86C, the melting point (93° C.) of the phenolic compound powder (90) and the melting point (121° C.) of the outer shell wall section OS of the magenta microcapsules 86M. Also, the magenta-developing area M3 is defined by a critical breaking-pressure curve PM3 of the magenta microcapsules 86M, the melting point (121° C.) of the outer shell wall section OS of the magenta microcapsules 86M and the primary azeotropic point (150° C.) of the mixed oil (yellow dye) contained in the yellow microcapsule 86Y. Further, the yellow-developing area Y3 is defined by a critical breaking-pressure curve PY3 and the primary azeotropic point (150° C.) of the mixed oil (yellow dye) contained in the yellow microcapsule 86Y.

As stated above, the yellow microcapsules 86Y can endure a pressure higher than the pressure 2.0 MPa when the temperature is lower than the primary axeotropic point (150° C.), and thus the microcapsules 86Y are not be squashed and broken due to the pressure exerted thereon. Nevertheless, the yellow microcapsules 86Y rupture themselves due to the abrupt increase in the internal pressure of the microcapsules 86Y when being heated to the temperature higher than the primary axeotropic point (150° C.), regardless of the pressure exerted thereon.

Thus, by suitably selecting a temperature and/or a pressure to be locally exerted on the single microcapsule layer 84 of the image-forming medium 80, it is possible to selectively break and rupture the cyan, magenta and yellow microcapsules 86C, 86M and 86Y at the localized area of the image-forming medium 80 at which the heating temperature and/or the breaking pressure are exerted.

Note, similar to the second embodiment, in the graph of FIG. 22, heating temperatures $T_1'$, $T_2'$ and $T_3'$ may be set as 100° C., 130° C. and 170° C., respectively, and breaking pressures $P_1'$, $P_2'$ and $P_3'$ may be set as 0.05 MPa, 0.5 MPa and 3.0 MPa, respectively.

Thus, it is possible to form a full color image on the image-forming medium 80, using the printer (FIGS. 6 and 7) modified for the image-forming medium 60 of the second embodiment.

Similar to the aforementioned cases, during a printing operation, the image-forming medium 80 is introduced into the entrance opening 32 such that the single microcapsule layer 84 is in direct contact with the thermal heads 40C, 40M and 40Y.

While the image-forming medium 80 passes between the first thermal head 40C and the first roller platen 42C without all the electric resistance elements $R_{c1}$ to $R_{cn}$ being energized, the single microcapsule layer 84 of the image-forming medium 80 is subjected to the breaking-pressure $P_3'$ (3.0 MPa) with the shearing force from each electric resistance element ($R_{c1}, \ldots, R_{cn}$) of the first thermal head 40C. Nevertheless, the breaking-pressure $P_3'$ with the shearing force cannot be exerted on the cyan, magenta and yellow microcapsules 86C, 86M and 86Y due to the existence of the rockwork-like structure of the single microcapsule layer 84.

Figure 23:
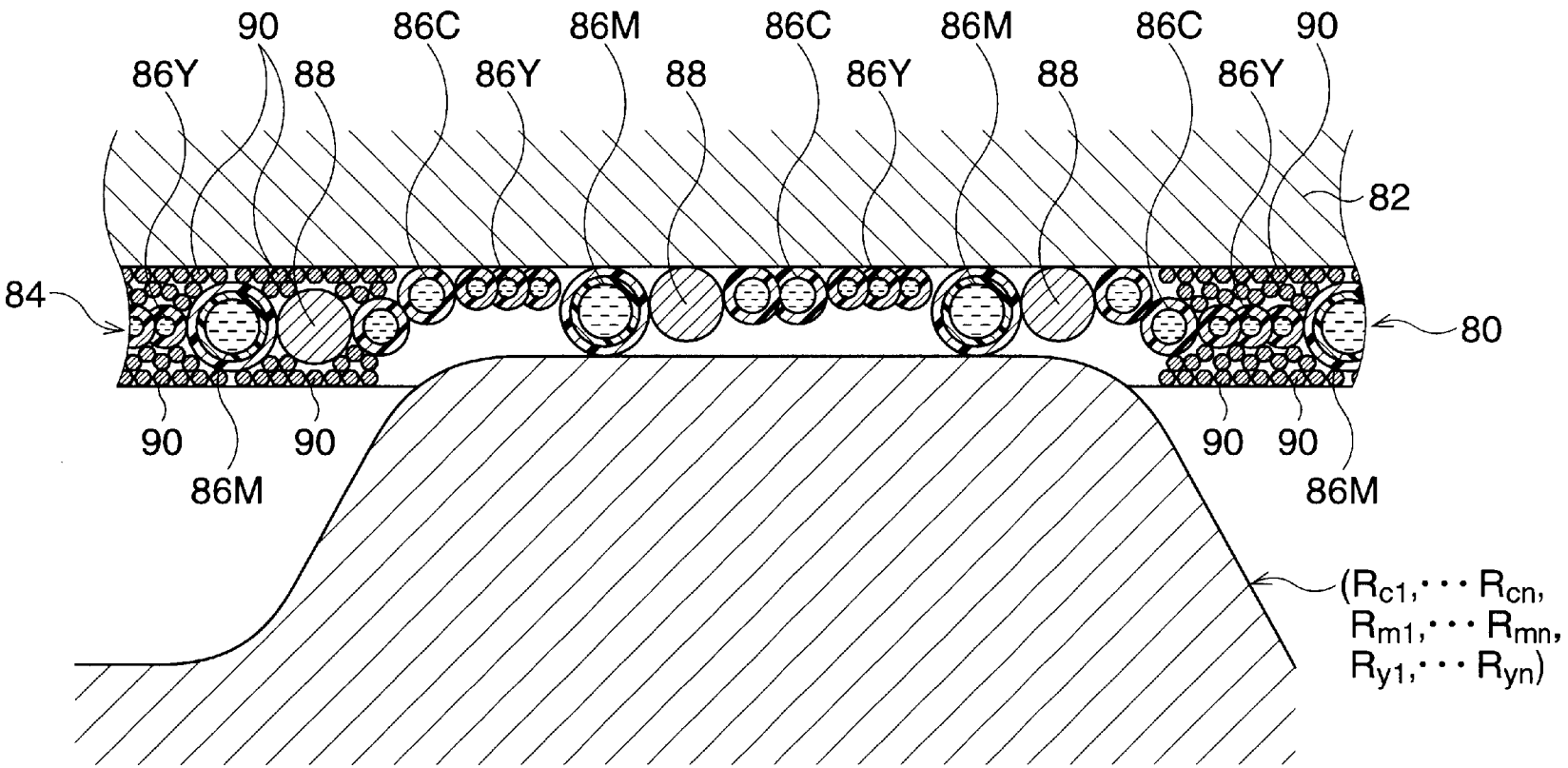
FIG. 23 is a schematic cross-sectional view showing penetration of an electric resistance element of either the first, second or third thermal head in the single microcapsule layer to thereby develop either a cyan, magenta or yellow dot on the image-forming medium shown in FIG. 19.

However, when any one of the electric resistance elements $R_{c1}$ to $R_{cn}$ is electrically energized to be heated to the temperature $T_1'$ (100° C.) higher than the melting point (93° C.) of the phenolic compound powder (90), the heated electric resistance element ($R_{c1}, \ldots, R_{cn}$) penetrates into the single microcapsule layer 84, as shown in FIG. 23 by way of example, because a portion of the rockwork-like structure of the single microcapsule layer 84, to which the heated element ($R_{c1}, \ldots, R_{cn}$) is applied, is thermally melted and collapsed. Thus, the cyan, magenta and yellow microcapsules 86C, 86M and 86Y, included in the collapsed portion of the rockwork-like structure, are directly subjected to the breaking-pressure $P_3'$ (3.0 MPa), with the shearing force, from the heated element ($R_{c1}, \ldots, R_{cn}$).

At this time, the magenta and yellow microcapsules 86M and 86Y can endure the breaking-pressure $P_3'$, with the shearing force, but the cyan microcapsules 86C cannot. Thus, only the cyan microcapsules 86C are squashed and broken, resulting in discharge of the cyan dye from the broken microcapsules 86C. The discharged cyan dye, based on the cyan-producing leuco-dye or leuco-compound (Blue200), reacts with the molten color developer (phenolic compound), thereby producing a cyan dot on the single microcapsule layer 84 of the image-forming medium 80 by the heated element ($R_{c1}, \ldots, R_{cn}$).

Note, in FIG. 23, although the molten color developer is not shown to avoid complication of illustration, it is absorbed into the fine clearances or pores of the rockwork-like structure of the single microcapsule layer 84 and the paper sheet 82.

While the image-forming medium 80 passes between the second thermal head 40M and the second roller platen 42M without all the electric resistance elements $R_{m1}$ to $R_{mn}$ being energized, the single microcapsule layer 84 of the image-forming medium 80 is subjected to the breaking-pressure $P_2'$ (0.5 MPa) with the shearing force from each electric resistance element ($R_{m1}, \ldots, R_{mn}$) of the second thermal head 40M. Nevertheless, the breaking-pressure $P_2'$, with the shearing force, cannot be exerted on the cyan, magenta and yellow microcapsules 86C, 86M and 86Y due to the existence of the rockwork-like structure of the single microcapsule layer 84.

However, when any one of the electric resistance elements $R_{m1}$ to $R_{mn}$ is electrically energized to be heated to the temperature $T_2'$ (130° C.) higher than the melting point (121° C.) of the outer shell wall section OS of the magenta microcapsules 86M, the heated electric resistance element ($R_{m1}, \ldots, R_{mn}$) penetrates into the single microcapsule layer 84 (FIG. 23) because a portion of the rockwork-like structure of the single microcapsule layer 84, to which the heated element ($R_{m1}, \ldots, R_{mn}$) is applied, is thermally melted and collapsed. Thus, the cyan, magenta and yellow microcapsules 86C, 86M and 86Y, included in the collapsed portion of the rockwork-like structure, are directly subjected to the breaking-pressure $P_2'$ (0.5 MPa), with the shearing force, from the heated element ($R_{m1}, \ldots, R_{mn}$).

At this time, the cyan and yellow microcapsules 86C and 86Y can endure the breaking-pressure $P_2'$, with the shearing force, but the magenta microcapsules 86M cannot. Thus, only the magenta microcapsules 86M are squashed and broken, resulting in discharge of the magenta dye from the broken microcapsules 86M. The discharged magenta dye, based on the magenta-producing leuco-dye or leuco-compound (Red-3), reacts with the molten color developer, thereby producing a magenta dot on the single microcapsule layer 84 of the image-forming medium 80 by the heated element ($R_{m1}, \ldots, R_{mn}$).

While the image-forming medium 80 passes between the third thermal head 40Y and the third roller platen 42Y without all the electric resistance elements $R_{y1}$ to $R_{yn}$ being energized, the single microcapsule layer 84 of the image-forming medium 80 is subjected to the breaking-pressure $P_1'$ (0.05 MPa), with the shearing force, from each electric resistance element ($R_{y}, \ldots, R_{yn}$) of the second thermal head 40M. Nevertheless, the breaking-pressure $P_1'$, with the shearing force, cannot be exerted on the cyan, magenta and yellow microcapsules 86C, 86M and 86Y due to the existence of the rockwork-like structure of the single microcapsule layer 84.

However, when any one of the electric resistance elements $R_{y1}$ to $R_{yn}$ is electrically energized to be heated to the temperature $T_3'$ (170° C.) higher than the primary azeotropic point (150° C.) of the mixed oil (yellow dye) contained in the yellow microcapsule 86Y, the heated electric resistance element ($R_{y1}$, . . . , $R_{yn}$) penetrates into the single microcapsule layer 84 (FIG. 25), because a portion of the rockwork-like structure of the single microcapsule layer 84, to which the heated element ($R_{y1}$, . . . , $R_{yn}$) is applied, is thermally melted and collapsed. Thus, the cyan, magenta and yellow microcapsules 86C, 86M and 86Y, included in the collapsed portion of the rockwork-like structure, are directly subjected to the breaking-pressure $P_1'$ (0.05 MPa), with the shearing force, from the heated element ($R_{y1}$, . . . , $R_{yn}$).

At this time, the cyan and magenta microcapsules 86C and 86M can endure the breaking-pressure $P_1'$, with the shearing force, but the yellow microcapsules 86Y thermally rupture themselves due to the abrupt increase in an internal pressure of the heated microcapsules 86Y, resulting in discharge of the yellow dye from the ruptured microcapsules 86Y. The discharged yellow dye, based on the yellow-producing leuco-dye or leuco-compound (I-3R), reacts with the molten color developer, thereby producing a yellow dot on the single microcapsule layer 84 of the image-forming medium 80 by the heated element ($R_{y1}$, . . . , $R_{yn}$).

The spacer particles 88, included in the microcapsule layer 84, have substantially the same function as the spacer particles 76, included the second microcapsule layer section 66C of the aforesaid image-forming medium 60. Namely, large-sized cyan microcapsules, which may be included in the single microcapsule layer 84, can be prevented from being concentrically subjected to either breaking-pressure $P_2'$ or $P_1'$, with the shearing force, due to the existence of the spacer particles 88, and thus cannot be uncontrollably and undesirably squashed and broken.

Similar to the second embodiment, the single microcapsule layer 84 of the image-forming medium 80 is not susceptible to noise. In particular, if a microcapsule (86Y, 86M, 86Y) included in the single microcapsule layer 84 is accidentally and mechanically broken, resulting in discharge of a leuco-compound-based dye from the broken microcapsule, the discharged leuco-compound-based dye cannot react with the color developer until it is heated to the melting point (93° C.) of the color developer temperature.

In the third the embodiment, the outer shell wall OS of the magenta microcapsules 86M may be formed of a suitable color developer, exhibiting a given thermal melting point. For example, for the outer shell wall OS of the magenta microcapsules 86M, it is possible to utilize oxybenzoic ether exhibiting a thermal melting point from about 110° C. to 118° C. In this case, it is possible to facilitate the color-developing reaction of a magenta dye, discharged from a broken magenta microcapsule (86C), due to the existence of a molten oxybenzoic ether surrounding the broken magenta microcapsule (86C).

Also, in the third embodiment, the inner and outer shell walls of the magenta microcapsules 86M may be substituted for each other. Namely, the outer shell wall section OS may be formed of the suitable amino resin, and the inner shell wall section IS may be formed of the olefin wax exhibiting a thermal melting point of about 121° C.

Note, of course, the various changes and modifications, stated with respect to the first and second embodiments, may be suitably applied to the third embodiment (FIG. 19), if necessary.

Finally, it will be understood by those skilled in the art that the foregoing description is of preferred embodiments of the medium, and that various changes and modifications may be made to the present invention without departing from the spirit and scope thereof.

The disclosure relates to subject matters contained in Japanese Patent Applications No. 11-348859 (filed on Dec. 8, 1999) and No. 2000-042507 (filed on Feb. 21, 2000), which are expressly incorporated herein, by reference, in their entireties.

What is claimed is:

1. An image-forming medium comprising:

a substrate; and a layer of microcapsules, coated over said substrate, composed of a binder material and a plurality of microcapsules filled with one of a dye and ink and uniformly distributed in said binder material;

wherein said binder material exhibits a predetermined thermal melting point, and said microcapsules exhibit a pressure-breaking characteristic so as to be squashed and broken under a predetermined pressure when said binder material is thermally softened or melted.

2. An image-forming medium as set forth in claim 1, wherein said binder material comprises a wax material exhibiting said thermal melting point.

3. An image-forming medium as set forth in claim 1, wherein said binder material comprises a low-melting thermoplastic material exhibiting said thermal melting point.

4. An image-forming medium as set forth in claim 1, wherein said binder material comprises a plurality of binder particles which are adhered to each other such that a rockwork-like structure is given to said microcapsule layer.

5. An image-forming medium as set forth in claim 1, wherein said microcapsule further includes a vehicle and a compound dispersed or dissolved in said vehicle.

6. An image-forming medium as set forth in claim 5, wherein said compound comprises a leuco-compound, and said binder material contains a color developer for said leuco-compound.

7. An image-forming medium as set forth in claim 1, wherein said microcapsules have a shell wall formed of a heat resistant synthetic resin.

8. An image-forming medium as set forth in claim 7, said heat resistant synthetic resin comprises a thermosetting resin.

9. An image-forming medium as set forth in claim 7, said heat resistant synthetic resin comprises a high-melting thermoplastic resin.

10. An image-forming medium as set forth in claim 1, wherein said one of a dye and ink is a dye comprising a leuco-compound-based dye, and said binder material comprises a color developer for said leuco-compound-based dye.

11. An image-forming medium as set forth in claim 10, wherein said color developer comprises a plurality of color developer particles which are adhered to each other such that a rockwork-like structure is given to said microcapsule layer.

12. An image-forming medium as set forth in claim 10, wherein said microcapsule layer contains a sensitizer for facilitating a color-developing reaction of said leuco-compound-based dye with said color developer.

13. An image-forming medium as set forth in claim 10, wherein said microcapsules have a shell wall formed of a heat resistant synthetic resin.

14. An image-forming medium as set forth in claim 13, said heat resistant synthetic resin comprises a thermosetting resin.

15. An image-forming medium as set forth in claim 13, said heat resistant synthetic resin comprises a high-melting thermoplastic resin.

16. An image-forming medium comprising:

a substrate; and a layer of microcapsules, coated over said substrate, including first and second microcapsule layer sections, said second microcapsule layer section being formed on said substrate, said first microcapsule layer section being formed on said second microcapsule layer section, said first microcapsule layer section being composed of a first binder material, and a first type of microcapsules filled with one of a first dye and ink and uniformly distributed in said first binder material, said second microcapsule layer section being composed of a second binder material, and a second type of microcapsules filled with one of a second dye and ink and uniformly distributed in said second binder material;

wherein said first binder material exhibits a first predetermined thermal melting point, and said first type of microcapsules exhibits a first pressure-breaking characteristic so as to be squashed and broken under a first predetermined pressure when said first binder material is thermally softened or melted, and wherein said second binder material exhibits a second predetermined thermal melting point higher than said first thermal melting point, and said second type of microcapsules exhibits a second pressure-breaking characteristic so as to be squashed and broken under a second predetermined pressure lower than said first predetermined pressure when said second binder material is thermally softened or melted.

17. An image-forming medium as set forth in claim 16, wherein an average diameter of said first type of microcapsules is smaller than an average diameter of said second type of microcapsules.

18. An image-forming medium as set forth in claim 16, wherein said first microcapsule layer section includes spacer particles uniformly distributed therein and having an average diameter larger than an average diameter of said first type of microcapsules.

19. An image-forming medium as set forth in claim 18, wherein said spacer particles are formed of an inorganic material.

20. An image-forming medium as set forth in claim 18, wherein said spacer particles are formed of a high-melting synthetic resin.

21. An image-forming medium as set forth in claim 16, wherein each of said first and second binder materials comprises a plurality of binder particles which are adhered to each other such that a rockwork-like structure is given to a corresponding microcapsule layer section.

22. An image-forming medium as set forth in claim 16, wherein each of said first and second types of microcapsules further includes a vehicle and a compound dispersed or dissolved in said vehicle.

23. An image-forming medium as set forth in claim 22, wherein said compound comprises a leuco-compound, and a color developer for said leuco-compound is contained in a corresponding microcapsule layer section.

24. An image-forming medium as set forth in claim 16, wherein said respective one of a first dye and ink and one of a second dye and ink are dyes comprising first and second leuco-compound-based dyes, and said respective first and second binder materials comprise first and second color developers for said leuco-compound-based dyes.

25. An image-forming medium as set forth in claim 24, wherein each of said first and second color developers comprises a plurality of color developer particles which are adhered to each other such that a rockwork-like structure is given to a corresponding microcapsule layer section.

26. An image-forming medium as set forth in claim 24, wherein each of said first and second microcapsule layer sections contains a sensitizer for facilitating a color-developing reaction of a corresponding leuco-compound-based dye with a corresponding color developer.

27. An image-forming medium as set forth in claim 16, wherein said microcapsule layer further includes a third microcapsule layer section intervened between said substrate and said second microcapsule layer section, said third microcapsule layer section being composed of a third binder material, and a third type of microcapsules filled with one of a third dye and ink and uniformly distributed in said third binder material, and wherein said third binder material exhibits a third predetermined thermal melting point higher than said second thermal melting point, said third type of microcapsules exhibiting a third pressure-breaking characteristic so as to be squashed and broken under a third predetermined pressure lower than said second predetermined pressure when said third binder material is thermally softened or melted.

28. An image-forming medium as set forth in claim 27, wherein an average diameter of said second type of microcapsules is smaller than an average diameter of said third type of microcapsules.

29. An image-forming medium as set forth in claim 27, wherein said first microcapsule layer section includes a first type of spacer particles uniformly distributed therein and having an average diameter larger than an average diameter of said first type of microcapsules, and said second microcapsule layer section includes a second type of spacer particles uniformly distributed therein and having an average diameter larger than an average diameter of said second type of microcapsules.

30. An image-forming medium as set forth in claim 27, wherein said third color developer comprises a plurality of color developer particles which are adhered to each other such that a rockwork-like structure is given to said third microcapsule layer section.

31. An image-forming medium as set forth in claim 27, wherein each of said first, second and third microcapsules further includes a vehicle and a compound dispersed or dissolved in said vehicle.

32. An image-forming medium as set forth in claim 31, wherein said compound comprises a leuco-compound, and a color developer for said leuco-compound is contained in a corresponding microcapsule layer section.

33. An image-forming medium as set forth in claim 27, wherein said respective one of a first dye and ink, one of a second dye and ink, and one of a third dye and ink are dyes comprising first, second and third leuco-compound-based dyes, and said respective first, second and third binder materials comprise first, second and third color developers for said leuco-compound-based dyes.

34. An image-forming medium as set forth in claim 33, wherein each of said first, second and third color developers comprises a plurality of color developer particles which are adhered to each other such that a rockwork-like structure is given to a corresponding microcapsule layer section.

35. An image-forming medium as set forth in claim 33, wherein each of said first, second and third microcapsule layer sections contains a sensitizer for facilitating a color-developing reaction of a corresponding leuco-compound-based dye with a corresponding color developer.

36. An image-forming medium comprising:

a substrate; and a layer of microcapsules, coated over said substrate, composed of a color developer, a first type of microcapsules filled with one of a first leuco-compound-based dye and ink and uniformly distributed in said color developer, and a second type of microcapsules filled with one of a second leuco-compound-based dye and ink and uniformly distributed in said color developer, said color developer exhibiting a predetermined thermal melting point, wherein said first type of microcapsules exhibits a first pressure-breaking characteristic so as to be squashed and broken under a first predetermined temperature higher than said predetermined thermal melting point and a first predetermined pressure when said color developer is thermally softened or melted, and wherein said second type of microcapsules exhibits a second pressure-breaking characteristic so as to be squashed and broken under a second predetermined temperature higher than said first predetermined temperature and a second predetermined pressure lower than said first predetermined pressure when said color developer is thermally softened or melted.

37. An image-forming medium as set forth in claim 36, wherein said second type of microcapsules has a double-shell-wall structure composed of an inner shell wall section and an outer shell wall section, one of which is thermally softened or melted under said second predetermined temperature.

38. An image-forming medium as set forth in claim 36, an average diameter of said first type of microcapsules is smaller than an average diameter of said second type of microcapsules, and said microcapsule layer includes a plurality of spacer particles having an average diameter larger than the average diameter of said first type of microcapsules but smaller than the average diameter of said second microcapsules.

39. An image-forming medium as set forth in claim 36, wherein said color developer comprises a plurality of color developer particles which are adhered to each other such that a rockwork-like structure is given to said microcapsule layer.

40. An image-forming medium as set forth in claim 36, wherein said microcapsule layer contains a sensitizer for facilitating a color-developing reaction of each leuco-compound-based dye with said color developer.

* * * * *